US010085601B2

(12) United States Patent
Fukano

(10) Patent No.: US 10,085,601 B2
(45) Date of Patent: Oct. 2, 2018

(54) HAND DRYER

(71) Applicant: Mitsubishi Electric Corporation, Chiyoda-ku, Tokyo (JP)

(72) Inventor: Manabu Fukano, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 246 days.

(21) Appl. No.: 15/012,295

(22) Filed: Feb. 1, 2016

(65) Prior Publication Data

US 2016/0143491 A1 May 26, 2016

Related U.S. Application Data

(63) Continuation of application No. 13/816,106, filed as application No. PCT/JP2011/051235 on Jan. 24, 2011, now Pat. No. 9,282,856.

(30) Foreign Application Priority Data

Aug. 18, 2010 (JP) ..... 2010-183027

(51) Int. Cl.
*F26B 25/06* (2006.01)
*A47K 10/48* (2006.01)

(52) U.S. Cl.
CPC ..... *A47K 10/48* (2013.01)

(58) Field of Classification Search
CPC ..... A47K 48/10; A47K 2210/00; F26B 3/02; F26B 3/04
USPC ..... 34/202, 210, 215
See application file for complete search history.

(56) References Cited

U.S. PATENT DOCUMENTS 5,031,337 A 7/1991 Pilolla et al.
5,459,944 A * 10/1995 Tatsutani ..... A47K 10/48 34/202

FOREIGN PATENT DOCUMENTS

EP 1 908 384 A1 4/2008
JP 5-293055 A 11/1993
JP 6-062977 A 3/1994
JP 06-62979 A 3/1994
(Continued)

OTHER PUBLICATIONS

Office Action (Examination Report under Section 18(3)), dated Sep. 21, 2016 by the British Intellectual Property Office in corresponding British Patent Application No. 1600377.4 (4 pages).
(Continued)

*Primary Examiner* — John McCormack
(74) *Attorney, Agent, or Firm* — Buchanan Ingersoll & Rooney PC

(57) ABSTRACT

A hand dryer includes a box body that includes a hand drying chamber whose upper portion and side portion are open, an airflow generating device that generates an airflow, a nozzle that is provided in the hand drying chamber and ejects an airflow generated in the airflow generating device, a first sensor provided in the hand drying chamber, a second sensor that is provided in the hand drying chamber and is provided at a position that is below the first sensor and is more outward than the first sensor in a horizontal direction, and a control unit that controls an operation of the airflow generating device in accordance with a signal from the first sensor or the second sensor.

11 Claims, 15 Drawing Sheets

(56) References Cited

FOREIGN PATENT DOCUMENTS

| | | | |
|---|---|---|---|
| JP | 6-062981 | A | 3/1994 |
| JP | 2000-300461 | A | 10/2000 |
| JP | 2001-104213 | A | 4/2001 |
| JP | 2006-081925 | A | 3/2006 |
| JP | 2008-110240 | A | 5/2008 |

OTHER PUBLICATIONS

Office Action (Examination Report under Section 18(3)), dated Sep. 19, 2016 and Sep. 23, 2016 by the British Intellectual Property Office in corresponding British Patent Application No. 1612749.0 (11 pages).
Search Report dated Jul. 26, 2016 by the British Intellectual Property Office in corresponding British Application No. 1600377.4 (6 pages).
International Search Report (PCT/ISA/210) dated Mar. 8, 2011, by the Japanese Patent Office as the International Searching Authority for International Application No. PCT/JP2011/051235.
Written Opinion (PCT/ISA/237) dated Mar. 8, 2011, by the Japanese Patent Office as the International Searching Authority for International Application No. PCT/JP2011/051235.
International Preliminary Report on Patentability (Form PCT/IB/373) and the Written Opinion of the International Searching Authority (Form PCT/ISA/237) dated Mar. 19, 2013, issued in corresponding International Application No. PCT/JP2011/051235. (6 pages).
Office Action (Notice of Rejection) dated Apr. 30, 2013, issued in corresponding Japanese Patent Application No. 2012-529495, and an English Translation of the Office Action. (6 pages).
Office Action issued on Apr. 29, 2015, by the Korean Patent Office in corresponding Korean Patent Application No. 10-2013-7004001, and an English Translation of the Office Action. (6 pages).
Office Action (Examination Report under Section 18(3)) dated Sep. 8, 2015, by the British Intellectual Property Office in corresponding British Patent Application No. GB1302585.3 (4 pages).
Decision of Refusal dated Oct. 30, 2015 by the Korean Intellectual Patent Office in corresponding Korean Patent Application No. 10-2013-7004001, with a partial English translation thereof (4 pages).
Korean Office Action dated Jan. 15, 2016 issued in corresponding Korean Patent Appln. No. 10-2015-7034249, with English translation (7 pages).
Korean Office Action (Notification of Reason for Refusal) dated Oct. 9, 2014, by the Korean Intellectual Patent Office in corresponding Korean Patent Application No. 10-2013-7004001, and an English Translation thereof. (7 pgs).

* cited by examiner

HAND DRYER

FIELD

The present invention relates to a hand dryer for drying a wet hand after washing.

BACKGROUND

As conventional hand dryers, for example, Japanese Patent Application Laid-open No. 06-62981 discloses a hand dryer that includes: a hand inserting unit that is provided such that hands can be inserted by opening the front surface and the side surfaces of a box body; outlet nozzles arranged in the upper and lower surface portions of the hand inserting unit; a high-pressure-air generating unit that draws air in the hand inserting unit and sends high pressure air to the outlet nozzles; and a sensor that is provided in the hand inserting unit and detects the insertion state of hands in the hand inserting unit. More specifically, it is disclosed that the hand inserting unit is sloped toward a lower portion so as to have a substantially U-shape, the sensor is composed of inlet upper-and-lower-side sensors provided on the inlet side in the upper and lower surface portions of the hand inserting unit and deep upper-and-lower-side sensors provided on the deep side in the upper and lower surface portions of the hand inserting unit, when hands are inserted as far as a position connecting between the deep upper-and-lower-side sensors, a hand detection signal is sent to a control circuit and the high-pressure-air generating unit is started, and, when hands are not detected by the inlet upper-and-lower-side sensors, the high-pressure-air generating unit is stopped.

CITATION LIST

Patent Literature

Patent Literature 1: Japanese Patent Application Laid-open No. 06-62981 (Claim 1, paragraphs [0019] and [0022] to [0023], and FIG. 1)

SUMMARY

Technical Problem

With the conventional hand dryer, after a user inserts wet hands downward into the hand inserting unit from the opening in the front surface of the box body, the user dries the hands by moving the hands upward and pulling out the hands from the opening in the front surface while applying wind from the outlet nozzles to the hands. However, in terms of the installation height of the hand dryer arranged, for example, in regular bathrooms other than bathrooms exclusively for children in schools or the like, the hand dryer is normally arranged substantially in accordance with the height of an adult so that adults can easily use the hand dryer, therefore, if a shorter person, such as a child, attempts to use the hand dryer, the position of the opening in the front surface is too high and the shorter person cannot sufficiently insert the hands as far as the deep portion of the hand inserting unit from the opening in the front surface. Thus, the hands are not detected by the deep upper-and-lower-side sensors and therefore the high-pressure-air generating unit is not operated, which leads to a problem in that the hand dryer cannot be used by inserting the hands from the opening in the front surface in the same manner as an adult does.

Moreover, even if a shorter person attempts to cause the deep upper-and-lower-side sensors to detect the his or her hands by inserting the hands from the openings in the side surfaces instead of the opening in the front surface, the deep upper-and-lower-side sensors are not directly visible to the user, and therefore the user cannot know where to insert the hands in the hand inserting unit and needs to move the hands back and forth inside the hand inserting unit. Moreover, because the deep upper-and-lower-side sensors are provided on the deep side of the hand inserting unit, which is also away from the openings in the side surfaces, for example, the hands cannot be detected unless the hands are purposefully inserted as far as the deep side of the hand inserting unit. This leads to a problem in that the hands are much less likely to be detected by the deep upper-and-lower-side sensors simply by inserting the hands. Moreover, the deep upper-and-lower-side sensors are provided on the deep side in the lower portion of the hand inserting unit positioned at a greater distance from the outlet nozzles, therefore, in order to dry hands by applying high speed air from the nozzles to the hands, the movement distance from the deep upper-and-lower-side sensors to the nozzles is large even if the hands are detected by the deep upper-and-lower-side sensors, which is a nuisance for a user. Moreover, there is a problem in that the hands can come into contact with the inner wall surface of the hand inserting unit while moving the hands back and forth inside the hand inserting unit to find the deep upper-and-lower-side sensors, therefore, washed hands become dirty.

The present invention is made for solving the above described problems and has an object to obtain a hand dryer that is user friendly regardless of difference in height among users such as adults and children.

Solution to Problem

A hand dryer according to the present invention includes: a box body that includes a hand drying chamber whose upper portion and side portion are open; an airflow generating device that is provided in the box body and generates an airflow; a nozzle that is provided on an inner wall surface of the hand drying chamber and ejects an airflow generated in the airflow generating device to the hand drying chamber; a first sensor provided on an inner wall surface of the hand drying chamber; a second sensor that is provided on an inner wall surface of the hand drying chamber and is provided at a position that is below the first sensor and is more outward than the first sensor in a horizontal direction; and a control unit that detects presence or absence of a hand in accordance with a signal from the first sensor or the second sensor and controls an operation of the airflow generating device.

Advantageous Effects of Invention

A hand dryer can be obtained, which can easily detect a hand by a second sensor by inserting the hand from an opening in a side portion of a hand drying chamber and is user friendly regardless of difference in height among users such as adults and children.

DESCRIPTION OF EMBODIMENTS

First Embodiment

Figure 1:
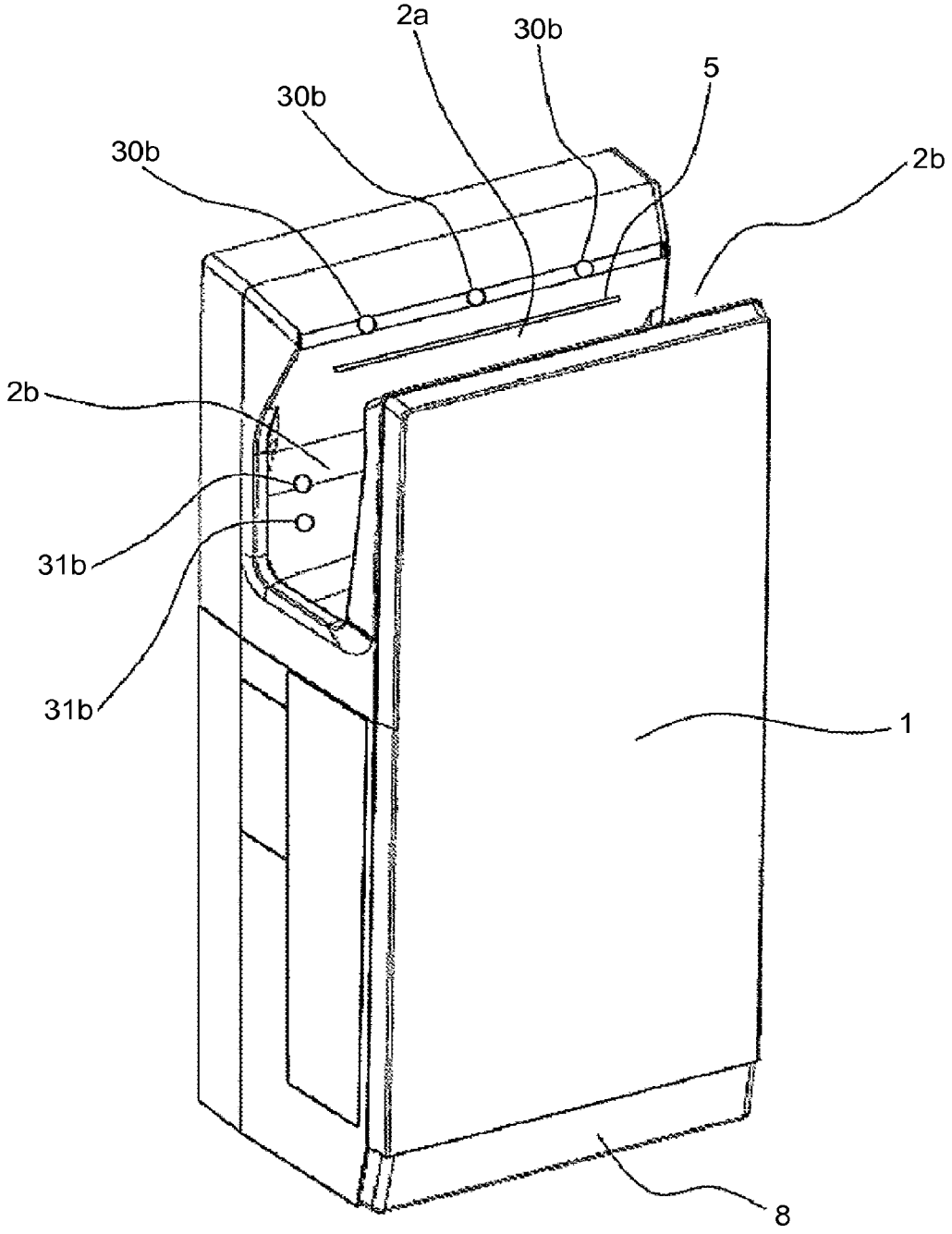
FIG. 1 is a perspective view illustrating the appearance of a hand dryer according to the first embodiment of this invention.
Figure 2:
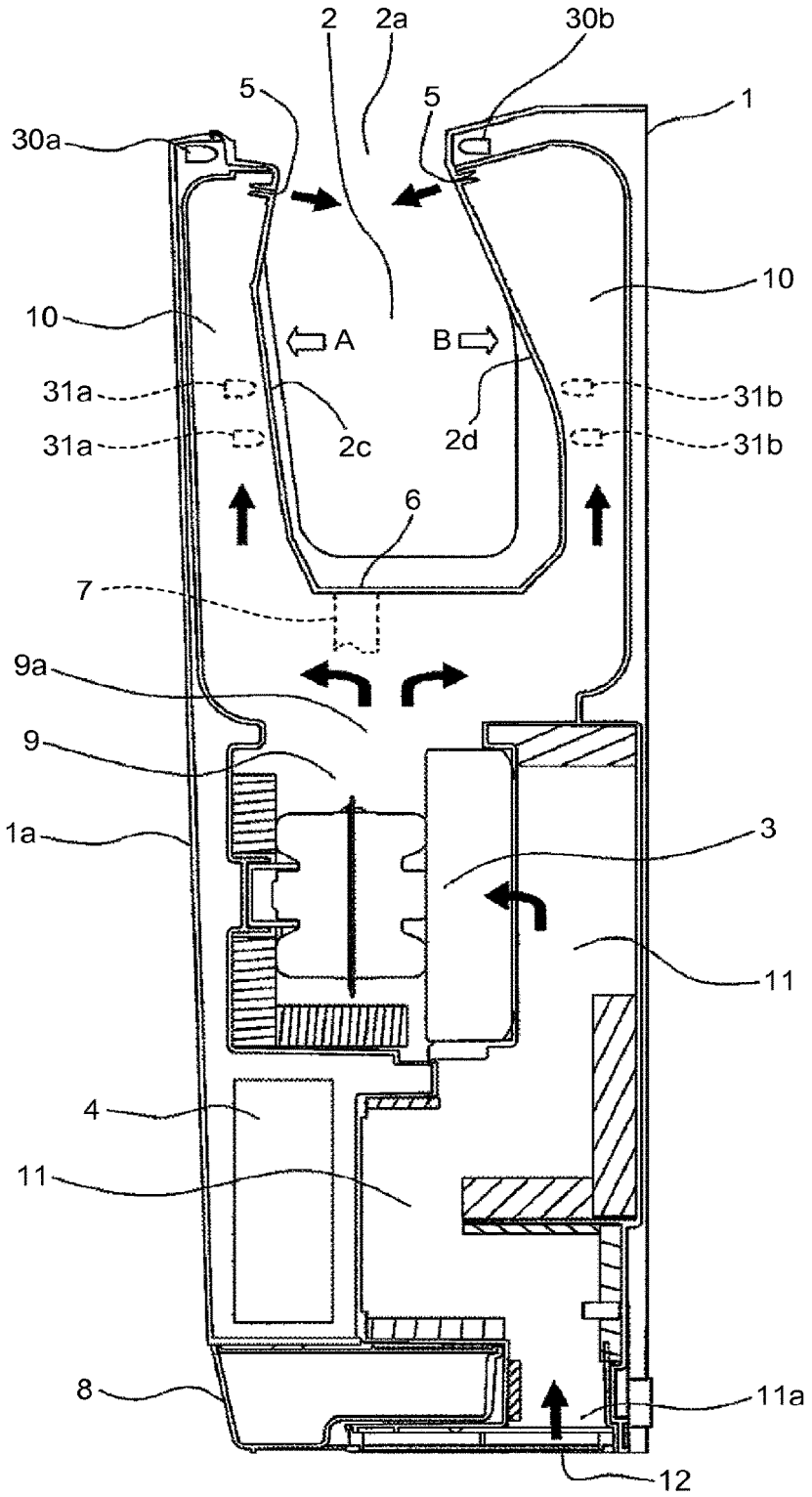
FIG. 2 is a right-side-surface cross-sectional view of the hand dryer according to the first embodiment of this invention.

FIG. 1 is a perspective view illustrating the appearance of a hand dryer according to the first embodiment of this invention. FIG. 2 is a right-side-surface cross-sectional view of the hand dryer according to the first embodiment for carrying out this invention. In FIG. 1 and FIG. 2, a box body 1 forms the outline of the hand dryer and is provided with a hand drying chamber 2, which is open in the upper portion and side portions so that a hand can be freely inserted thereinto and removed therefrom and is downwardly sloped toward the back surface when viewed from the side surface to form a substantially U-shaped space. Moreover, the box body 1 is provided with an airflow generating device 3 that generates airflow and a control unit 4 that controls the operation of the airflow generating device 3, and the control unit 4 starts the airflow generating device 3 in accordance with a signal output from first sensors (light receiving side) 30*b* or second sensors (light receiving side) 31*b* provided in the hand drying chamber 2 and causes the airflow generating device 3 to eject the generated airflow from nozzles 5, which are provided in the inner wall surface of the hand drying chamber 2, into the hand drying chamber 2. A drainage port 6 that drains water in the hand drying chamber 2 is provided in the bottom surface of the hand drying chamber 2, one end of a pipe-shaped drain channel 7 is attached to the drainage port 6, and a tank 8 for storing water drained through the drain channel 7 is detachably attached to the box body 1 below the other end (not shown) of the drain channel 7.

An upper opening 2*a*, which is the mouth of the opening in the upper portion of the hand drying chamber 2, and side openings 2*b*, which are the mouths of the openings in the side portions of the hand drying chamber 2, communicate with each other, therefore, a user regards the upper opening 2*a* and the side openings 2*b* as one opening and can insert and remove the hand into and from any part of the upper openings 2*a* and the side openings 2*b*. In terms of the shape in which the upper portion of the hand drying chamber 2 is open, the opening may be formed in the upper surface of the box body 1 or may be formed in the front surface of the box body 1. The hand drying chamber 2 includes a front-side wall surface 2*c* that makes up the inner wall surface on the front side of the hand drying chamber 2 and a back-side wall surface 2*d* that makes up the inner wall surface on the back side of the hand drying chamber 2 opposing the front-side wall surface 2*c* and is made of resin impregnated with an antibacterial agent, and, for example, a silicon-based or fluorine-based water-repellent coating is applied to the surface of the hand drying chamber 2. Therefore, adhesion of dirt to the front-side wall surface 2*c* and the back-side wall surface 2*d* is reduced and the proliferation of bacteria is suppressed.

The nozzle 5, which extends substantially linearly in a horizontal direction when viewed from the front surface of the box body 1, is provided on each of the front-side wall surface 2*c* and the back-side wall surface 2*d* at a position that is above the center of the hand drying chamber 2 in a vertical direction and is as close as possible to the upper opening 2*a*, and the nozzles 5 are oriented at an ejection angle to eject air toward the deep side of the hand drying chamber 2. The nozzles 5 are provided at positions that are above the center of the hand drying chamber 2 in the vertical direction and are as close as possible to the upper opening 2*a*, therefore, the area below the nozzles 5 in the hand drying chamber 2 is ensured of having a length necessary for accommodating a hand and the length above the nozzles 5 in the hand drying chamber 2 is made as short as possible to shorten the length of the entire hand drying chamber 2 in the vertical direction, thereby reducing the size of the hand dryer in the vertical direction as much as possible.

The box body 1 is provided with the airflow generating device 3, such as a high pressure blower composed of blades and a motor, which generates high pressure airflow, below the hand drying chamber 2; and the airflow generating device 3 is accommodated in an exhaust chamber 9. Exhaust ducts 10, which are provided on the front side and the back side with the hand drying chamber 2 therebetween, are connected to an exhaust port 9*a* of the exhaust chamber 9; and the exhaust ducts 10 communicate with the nozzles 5 provided in the front-side wall surface 2*c* and the back-side wall surface 2*d*. Moreover, an intake port (not shown) of the airflow generating device 3 is connected to one of intake ducts 11 and the other of the intake ducts 11 opens downward in the lower portion of the box body 1 to form an intake port 11*a*. A filter 12 for cleaning the air is detachably provided in the intake port 11*a*. Accordingly, an air trunk is formed, which passes through the intake ducts 11 from the intake port 11*a*, passes through the exhaust chamber 9 via the airflow generating device 3, passes through the exhaust ducts 10, and communicates with the nozzles 5.

Figure 3:
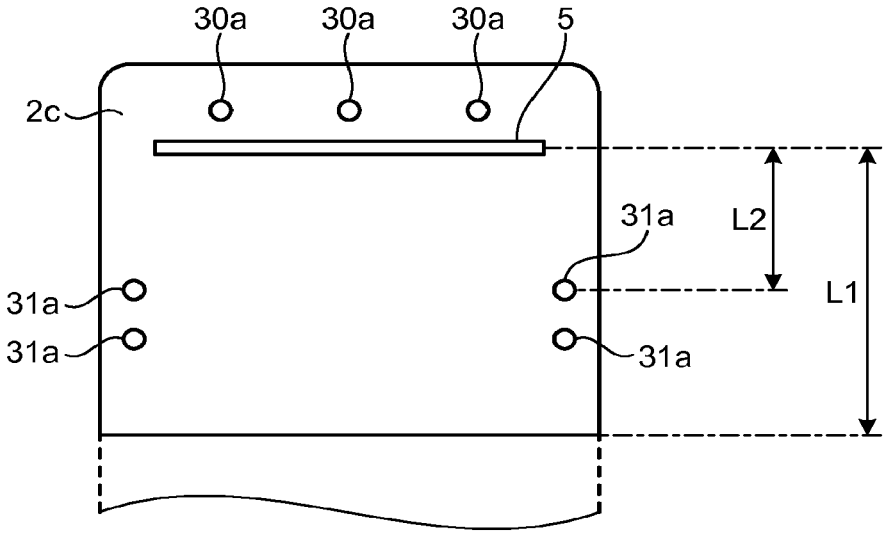
FIG. 3 is an explanatory diagram of the hand dryer according to the first embodiment of this invention illustrating the arrangement of sensors and a nozzle on the inner wall surface of the hand drying chamber viewed in the direction of an arrow A in FIG. 2.
Figure 4:
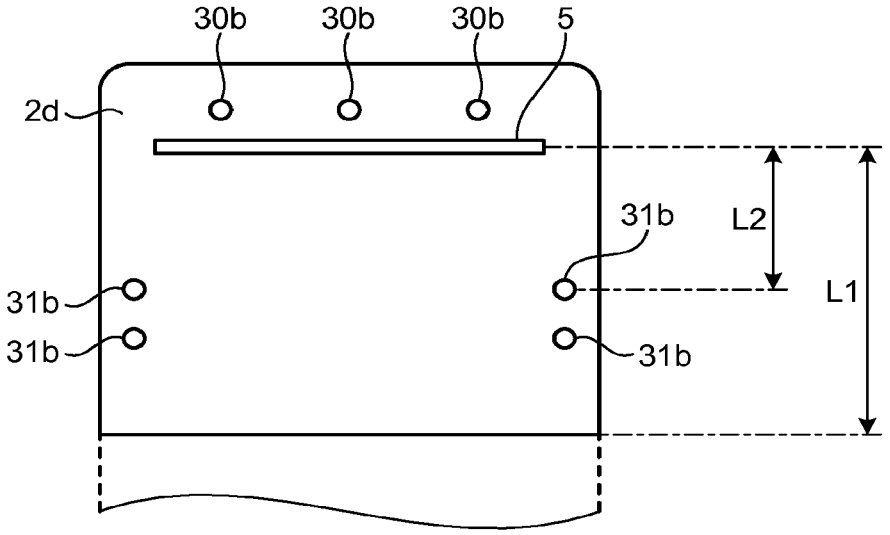
FIG. 4 is an explanatory diagram of the hand dryer according to the first embodiment of this invention illustrating the arrangement of sensors and a nozzle on the inner wall surface of a hand inserting unit viewed in the direction of an arrow B in FIG. 2.

FIG. 3 is an explanatory diagram of the hand dryer according to the first embodiment of this invention illustrating the arrangement of the sensors and the nozzle on the inner wall surface of the hand drying chamber viewed in the direction of an arrow A in FIG. 2. FIG. 4 is an explanatory diagram of the hand dryer according to the first embodiment of this invention illustrating the arrangement of the sensors and the nozzle on the inner wall surface of a hand inserting unit viewed in the direction of an arrow B in FIG. 2. As shown in FIG. 3, on the front-side wall surface 2*c*, three first sensors (light emitting side) 30*a*, which are light emitting side elements of a first sensor 30 for detecting the presence or absence of a hand, are provided at a position, which is above the center of the hand drying chamber 2 in the vertical direction, is as close as possible to the nozzle 5, and is on the upper opening 2*a* side of the nozzle 5. The first sensors (light emitting side) 30*a* are spaced apart in the horizontal direction and are located closer to the center than both ends of the nozzle 5 in the horizontal direction.

Moreover, on the front-side wall surface 2*c*, two second sensors (light emitting side) 31*a*, which are light emitting side elements of a second sensor 31, are provided spaced apart in the vertical direction at each position, which is below the first sensors (light emitting side) 30*a* and the nozzle 5 and is more outward than the nozzle 5 in the horizontal direction, to exhibit bilateral symmetry. Moreover, in terms of the positional relationship in the vertical direction among the nozzle 5, the second sensors (light emitting side) 31*a*, and the bottom surface of the hand drying chamber 2, they are arranged such that L2 falls within the range from $L2 \approx \frac{1}{2} \times L1$ to $L2 > \frac{1}{2} \times L1$, where L2 is the distance in the vertical direction between the nozzle 5 and the second sensors (light emitting side) 31*a*; and L1 is the distance in the vertical direction between the nozzle 5 and the bottom surface of the hand drying chamber 2. Although not shown, when one second sensor (light emitting side) 31*a* is provided on each of the right and left sides, it is sufficient to provide them at positions that satisfy $L2 \approx \frac{1}{2} \times L1$. The number of elements of each of the first sensor 30 and the second sensor 31 is not limited to the above number.

As shown in FIG. 4, first sensors (light receiving side) 30*b*, which are light receiving side elements of the first sensor 30, and the second sensors (light receiving side) 31*b*, which are light receiving side elements of the second sensor 31, are provided also on the back-side wall surface 2*d* in an arrangement similar to the front-side wall surface 2*c*, and are opposed to the first sensors (light emitting side) 30*a* and the second sensors (light emitting side) 31*a*, respectively. Infrared-rays are emitted from the first sensors (light emitting side) 30*a* and the second sensors (light emitting side) 31*a* at a staggered light emission timing and are received by the first sensors (light receiving side) 30*b* and the second sensors (light receiving side) 31*b*, respectively. If there is an object to be dried, such as a hand, between the first sensors (light emitting side) 30*a* and the first sensors (light receiving side) 30*b* or between the second sensors (light emitting side) 31*a* and the second sensors (light receiving side) 31*b*, the emitted infrared-rays are blocked, and therefore the amount of light received by the first sensors (light receiving side) 30*b* or the second sensors (light receiving side) 31*b* changes and a signal is output in accordance with the amount of received light. The output signal output from the first sensors (light receiving side) 30*b* or the second sensors (light receiving side) 31*b* is input to the control unit 4 and the control unit 4 determines the presence or absence of an object to be dried by comparing the input signal level with a predetermined threshold.

Next, the airflow when the hand dryer is operated will be explained. When a wet hand, which is an object to be dried, is inserted into the hand drying chamber 2, the control unit 4 determines that there is an object to be dried, such as a hand, in accordance with an output signal from the first sensor 30 or the second sensor 31 and starts up the airflow generating device 3. Air outside the hand dryer cleaned by the filter 12 is drawn from the intake port 11*a* and then is drawn from an intake port (not shown) in the airflow generating device 3 through the intake ducts 11. The drawn air is pressurized in the airflow generating device 3 and is exhausted into the exhaust chamber 9. Then, the air passes through the exhaust ducts 10 and is converted into high speed air in the nozzles 5 to be ejected into the hand drying chamber 2. Each one of the nozzles 5 is linearly provided, therefore, the high speed air ejected from the nozzles 5 is ejected to form an air curtain and is linearly applied to both sides, i.e., the palm and back, of a wet hand inserted into the hand drying chamber 2, thereby blowing off water that is present on the surface of the hand.

Then, when the inserted hand is pulled out of the hand drying chamber 2 from the upper opening 2*a*, high speed air forming an air curtain moves from a portion near the wrist toward the fingertips of the hand while blowing off water, whereby water that is present all over the hand is blown off and the hand is dried. When the hand is pulled out of the hand drying chamber 2, the control unit 4 determines that there is no hand present in accordance with an output signal from the first sensor 30 and the second sensor 31 and stops the airflow generating device 3. The water blown away from the wet hand inserted into the hand drying chamber 2 is blown to the hand drying chamber 2, strikes and flows down the front-side wall surface 2*c* and the back-side wall surface 2*d*, and is stored in the tank 8 through the drain channel 7 from the drainage port 6 provided in the bottom surface of the hand drying chamber 2.

Figure 5:
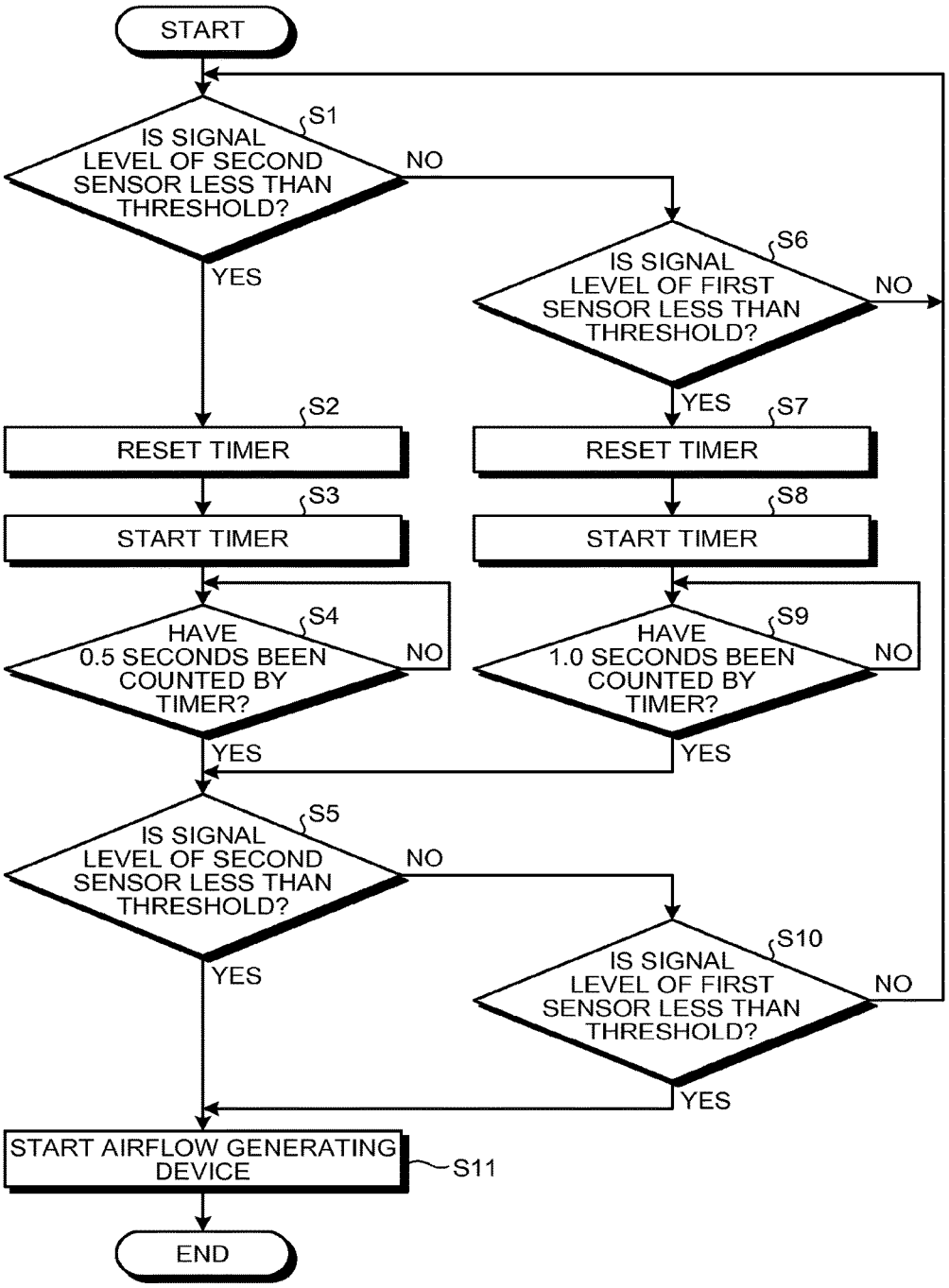
FIG. 5 is a flowchart until the starting of a high-pressure-airflow generating device of the hand dryer according to the first embodiment of this invention.

Next, an explanation is given of the control content of the control unit 4 that controls the operation of the airflow generating device 3 in accordance with a signal from the first sensor 30 or the second sensor 31. FIG. 5 is a flowchart until the starting of the airflow generating device 3 of the hand dryer according to the first embodiment of this invention. In FIG. 5, S1 to S11 represent each step of the flow. When the power (not shown) of the hand dryer is turned on, electricity is supplied to the control unit 4 to enter S1 in a standby state in which the first sensor 30 and the second sensor 31 are operated and the hand dryer waits for the hand of a user to be inserted. In S1, it is determined whether the level of an output signal from the second sensor 31 is less than a predetermined threshold. If the level is less than the predetermined threshold, the system control proceeds to S2, and otherwise, it proceeds to S6. In S6, it is determined whether the level of an output signal from the first sensor 30 is less than a predetermined threshold. If the level is less than the predetermined threshold, the system control proceeds to S7, and otherwise, it returns to S1.

In S2, a built-in timer (not shown) is reset and the system control thereafter proceeds to S3. In S3, the timer (not shown) reset in S2 is started and the system control thereafter proceeds to S4. In S4, it is determined whether the timer (not shown) started in S3 has counted elapse of a predetermined time (t2). In the present embodiment, because t2 is set to 0.5 seconds, it is determined whether the timer (not shown) has counted the elapse of 0.5 seconds. If the elapse of 0.5 seconds have been counted, the system control proceeds to S5, and if the elapse of 0.5 seconds have not been counted, the system control returns to S4. In S7, the built-in timer (not shown) is reset and the system control thereafter proceeds to S8. In S8, the timer (not shown) reset in S7 is started and the system control thereafter proceeds to S9. In S9, it is determined whether the timer (not shown) started in S8 has counted elapse of a predetermined time (t1). In the present embodiment, because t1 is set to 1.0 second, it is determined whether the timer (not shown) has counted 1.0 second. If 1.0 second has been counted, the system control proceeds to S5, and if 1.0 second has not been counted, the system control returns to S9.

In S5, it is determined whether the level of an output signal from the second sensor 31 is less than a predetermined threshold. If the level is less than the predetermined threshold, the system control proceeds to S11, and otherwise, it proceeds to S10. In S10, it is determined whether the level of an output signal from the first sensor 30 is less than a predetermined threshold. If the level is less than the predetermined threshold, the system control proceeds to S11, and otherwise, it returns to S1. In S11, the airflow generating device 3 is started.

Once the airflow generating device 3 is started, if the level of an output signal from at least any one of the first sensor 30 and the second sensor 31 is less than a predetermined threshold, the airflow generating device 3 continues to be operated. If the level of an output signal from neither of the first sensor 30 nor the second sensor 31 is less than a predetermined threshold, the airflow generating device 3 is stopped.

Figure 6:
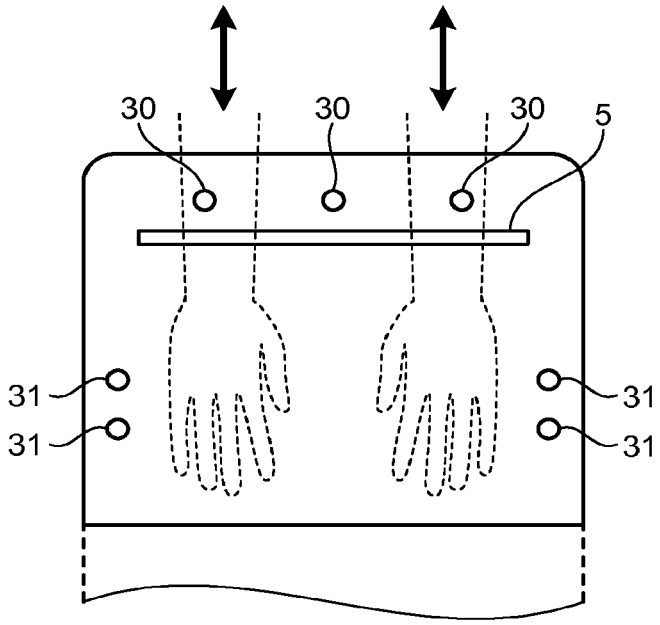
FIG. 6 is an explanatory diagram of the hand dryer according to the first embodiment of this invention showing the hand drying chamber when a person taller than a child, such as an adult, inserts the hands from an upper opening viewed from the front surface perspectively.

Next, an explanation is specifically given of a case where wet hands are inserted. FIG. 6 is an explanatory diagram of the hand dryer according to the first embodiment of this invention showing the hand drying chamber 2 when a person taller than a child, such as an adult, inserts the hands from the upper opening 2*a* viewed from the front surface perspectively. When a user stands in front of the hand dryer after washing hands and starts inserting both hands downward into the hand drying chamber 2 from the upper opening 2*a* in a state where the palms are open, the first sensor 30 is blocked by a portion near the fingertips, therefore, the level of an output signal from the first sensor 30 decreases and the system control proceeds to S8 from S6 and proceeds up to S9. Because 1.0 second is caused to elapse in S9, the wet portion from the fingertips to the wrists of both hands, which continue to be inserted downward during this period, sufficiently enters the hand drying chamber 2, therefore, the first sensor 30 is blocked by a portion near the arms and the output signal from the first sensor 30 is kept low. Thus, the system control proceeds to S11 from S10, and the airflow generating device 3 is started and high speed air is ejected from the nozzles 5.

When the high speed air is ejected from the nozzles 5, the user moves both hands upward in a state where the palms are open, therefore, the high speed air starts to be applied to the palms and backs of the hands near the wrists due to this movement. Then, when both hands are pulled out of the upper opening 2*a*, water that is present all over the hands from the wrists to the fingertips is blown off and the hands are dried. When both hands are completely pulled out of the upper opening 2*a*, neither the first sensor 30 nor the second sensor 31 is blocked by the hands, therefore, the level of an output signal from neither of them is less than a predetermined threshold and thus the airflow generating device 3 is stopped.

Figure 7:
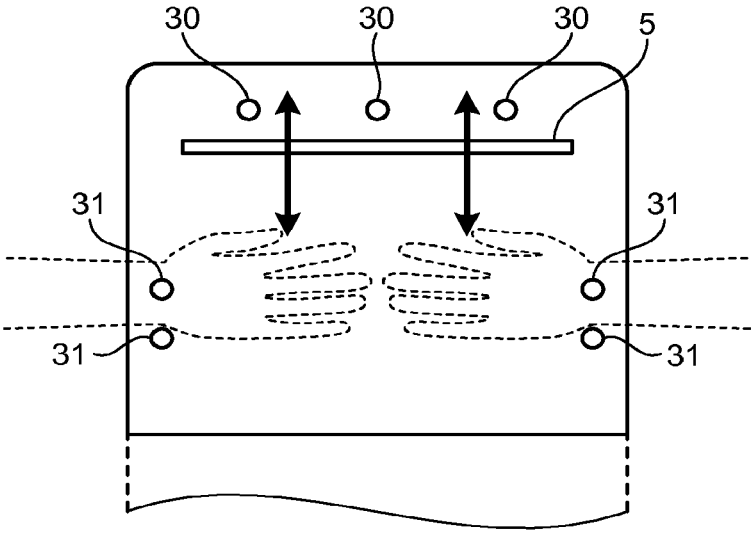
FIG. 7 is an explanatory diagram of the hand dryer according to the first embodiment of this invention showing the hand drying chamber when a person shorter than an adult, such as a child, inserts the hands from side openings viewed from the front surface perspectively.

FIG. 7 is an explanatory diagram of the hand dryer according to the first embodiment of this invention showing the hand drying chamber 2 when a person shorter than an adult, such as a child, inserts the hands from the side openings 2*b* viewed from the front surface perspectively. As shown in FIG. 7, when a user stands in front of the hand dryer after washing hands and starts inserting both hands into the hand drying chamber 2 from the side openings 2*b* in the horizontal direction in a state where both arms are nearly horizontal and the palms are open, the second sensor 31 is blocked by a portion near the fingertips, therefore, the level of an output signal from the second sensor 31 decreases and the system control proceeds to S2 from S1 and proceeds up to S4. Because 0.5 seconds are caused to elapse in S4, the wet portion from the fingertips to the wrists of both hands, which continue to be inserted during this period, sufficiently enters the hand drying chamber 2, therefore, the second sensor 31 is blocked by a portion near the arms and the output signal from the second sensor 31 is kept low. Thus, the system control proceeds to S11 from S5, and the airflow generating device 3 is started and high speed air is ejected from the nozzles 5.

When the high speed air is ejected, the user dries all over the hands by pulling out the hands from the upper opening 2*a*. A particularly short person can use the hand dryer in such a way that, after inserting both hands from the side openings 2*b*, only the palms and backs of the hands are moved upward without moving the entire arms so that both arms form an inverted V-shape, and the hands are pulled out from the side openings 2*b* after drying.

Figure 8:
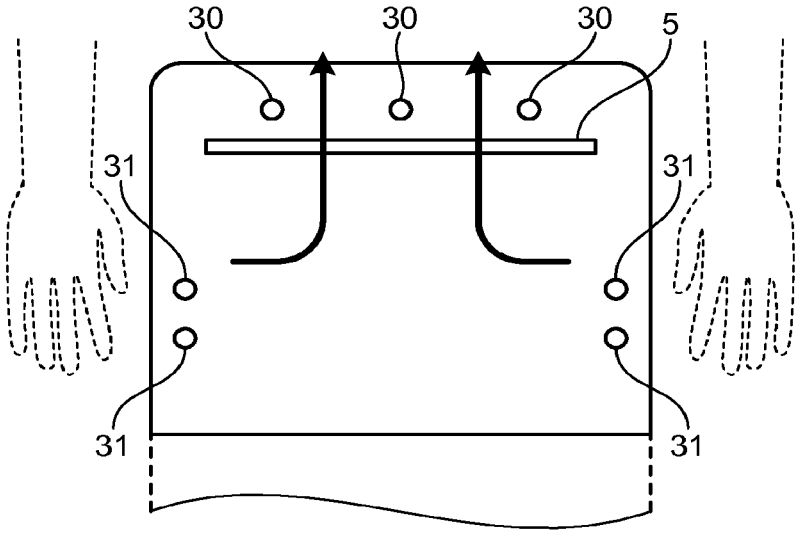
FIG. 8 is an explanatory diagram of the hand dryer according to the first embodiment of this invention showing the hand drying chamber when a person taller than a child, such as an adult, inserts the hands from the side openings viewed from the front surface perspectively.

FIG. 8 illustrates another method of using the hand dryer according to the first embodiment of this invention by a person taller than a child, such as an adult, and is an explanatory diagram showing the hand drying chamber 2 when the hands are inserted from the side openings 2*b* viewed from the front surface perspectively. As shown in FIG. 8, when a user starts inserting the hands into the hand drying chamber 2 from the side openings 2*b* on the right and left sides by moving the hands in the horizontal direction in a state where both arms extend downward and the palms are open, the second sensor 31 is blocked by a portion near the side ends of the palms and backs of the hands. Therefore, the level of an output signal from the second sensor 31 decreases and the system control proceeds to S2 from S1 and proceeds up to S4. Because 0.5 seconds are caused to elapse in S4, the wet portion from the fingertips to the wrists of both hands, which continue to be inserted during this period, sufficiently enters the hand drying chamber 2, therefore, the first sensor 30 is blocked by a portion near the arms and the output signal from the first sensor 30 decreases. Thus, the system control proceeds to S11 from S10, and the airflow generating device 3 is started and high speed air is ejected from the nozzles 5, therefore, the user dries all over the hands by pulling out the hands from the upper opening 2*a*.

According to the hand dryer having the above configuration, because the first sensor 30 and the second sensor 31, which is disposed below the first sensor 30 and more outward than the first sensor 30 in the horizontal direction, are provided, even if the hand dryer is arranged substantially in accordance with the height of an adult, a person taller than a child, such as an adult, can use the hand dryer by inserting the hands from the upper opening 2*a*. Moreover, because the first sensor 30 is arranged above the second sensor 31 and near the upper opening 2*a*, the first sensor 30 is visible, therefore, the hands can be inserted toward the first sensor 30 and detected by surely blocking the sensor, which is user-friendly.

Moreover, even for a person shorter than an adult, such as a child, who cannot insert the hands as far as the deep side of the hand drying chamber 2 from the upper opening 2*a* because the upper opening 2*a* is too height, as shown in FIG. 7, because the second sensor 31 is provided more outward than the first sensor 30 in the horizontal direction and thus the second sensor 31 is located near the side openings 2*b*, when the hands are inserted from the side openings 2*b*, a user can easily view the second sensor 31 from the side openings 2*b*, therefore, the hands can be inserted toward the second sensor 31 and easily detected by blocking the sensor. Moreover, it is not necessary to move the hands back and forth in the deep side of the hand drying chamber 2 to find an unseen sensor, therefore, it is possible to reduce the occurrence of the hands inadvertently coming into contact with the inner wall surface of the hand drying chamber 2 and the washed hands becoming dirty. Moreover, because the second sensor 31 is located near the side openings 2*b*, even if the hands are not inserted as far as the deep side of the hand drying chamber 2 on purpose, the hands are easily detected by the second sensor 31 by inserting the hands in a normal fashion, which is user-friendly. Additionally, when the hands are inserted from the side openings 2*b*, if the hands are just casually inserted, the hands inserted from the side openings 2*b* are generally inserted from near the center of the side openings 2*b* in the vertical direction, and as the second sensor 31 is arranged below the first sensor 30 and is close to the center of the side openings 2*b* in the vertical direction, the hands inserted from the side openings 2*b* are easily detected by the second sensor 31, which is user-friendly.

Moreover, when an inexperienced user of the hand dryer waits for the airflow generating device 3 to start in a state where the hands in the hand drying chamber 2 cannot be seen, the user may be concerned about when the airflow generating device 3 will start and may be surprised and pull the hands out of the hand drying chamber 2 when the airflow generating device 3 starts. However, even if the user does not insert the hands as far as the deep side of the hand drying chamber 2 from the side openings 2*b*, the user can insert the hands as far as the position of the second sensor 31 near the side openings 2*b* and insert the hands into the hand drying chamber 2 from the side openings 2*b* after waiting for the airflow generating device 3 to start, therefore, even an inexperienced user can feel at ease when using the hand dryer.

Moreover, because the first sensor 30 is provided at a position closer to the nozzles 5 than the second sensor 31, when a person taller than a child, such as an adult, dries the hands by inserting the hands from the upper opening 2*a*, if the hands are near the nozzles 5, the hands are detected by the first sensor 30 and the hands can be dried by causing the airflow generating device 3 to operate continuously. On the other hand, if the hands are not near the nozzles 5, the airflow generating device 3 can be immediately stopped by the first sensor 30. Therefore, if the hands are near the nozzles 5, the airflow generating device 3 is not stopped, and unnecessary operations, such as causing the airflow generating device 3 to operate when the hands are no longer present near the nozzles 5, can be avoided. Even in a case where a shorter person, such as a child, inserts the hands from the side openings 2*b* as shown in FIG. 7, if the person moves the arms upward for drying the hands by applying high speed air from the nozzles 5 and the second sensor 31 does not detect the arms, the same effect can be obtained.

Moreover, because the second sensor 31 is provided below the nozzles 5, when a shorter person, such as a child, dries the hands by inserting the hands from the side openings 2*b*, the wet hands are always positioned below the nozzles 5. Therefore, the wet hands (the portion from the wrists to the fingertips) do not protrude above high speed air ejected from the nozzles 5 or the protrusion amount of the hands is reduced. Thus, it is possible to prevent or reduce water on the wet hands protruding above high speed air ejected from the nozzles 5 being splashed outside the hand drying chamber 2 by the high speed air.

Moreover, because the second sensor 31 is provided more outward than the nozzles 5 in the horizontal direction, when a shorter person, such as a child, uses the hand dryer by inserting the hands from the side openings 2*b*, high speed air from the nozzles 5 is not applied to the hands if the airflow generating device 3 is started by inserting a portion near the fingertips as far as the position of the second sensor 31. Therefore, even an inexperienced user of the hand dryer can insert the hands into the hand drying chamber 2 after surely starting the airflow generating device 3 at the position at which high speed air from the nozzles 5 is not applied to the hands. This means that high speed air is not suddenly applied to the hands in a state where a user cannot see the hands in the hand drying chamber 2, therefore, the user is not surprised and can feel at ease when using the hand dryer.

Moreover, in terms of the size of the palm of a human hand: the width of the hand is approximately equal to half the length of the hand. The length of the hand is a distance from the wrist to the fingertips, and the width of the hand is orthogonal direction to the length of the hand. The distance L1 in the vertical direction between the nozzle 5 and the bottom surface of the hand drying chamber 2 indispensably needs to have a length capable of accommodating a portion from the wrist to the fingertips of a normal adult. However, if the distance L1 is made longer than necessary, the size of the hand dryer increases, which reduces the ease of installation, therefore, the distance L1 is set substantially in accordance with the size from the wrist to the fingertips of a normal adult hand. Because the second sensor 31 is provided below the intermediate position between the nozzle 5 and the bottom surface of the hand drying chamber 2, the distance L2 between the nozzle 5 and the second sensor 31 becomes equal to or larger than the width of a hand. Therefore, even if the hands of a normal adult are inserted from the side openings 2*b* in a state where the arms are nearly horizontal with a usage similar to that shown in FIG. 7, high speed air from the nozzles 5 is not directly applied to the hands in a state where the hands are detected by the second sensor 31. This effect is obtained all the more because a person who inserts the arms from the side openings 2*b* in a state where the arms are horizontal is in most cases a shorter person, such as a child, in terms of usability and the width of the hands of the shorter person is small.

Therefore, even when the timer has counted t2=0.5 seconds or more and high speed air is ejected from the nozzles 5 while inserting hands due to the effect of the insertion speed or the like such as in the case where the hands of an adult or a child are slowly inserted or a user once stops inserting the hands halfway by a usage similar to that shown in FIG. 7, the high speed air from the nozzles 5 is not directly applied to the hands and the wet hands do not protrude above the high speed air from the nozzles 5. Thus, water on the hands is not splashed outside the hand dryer while inserting the hands. Moreover, because the second sensor 31 closest to the nozzle 5 satisfies L2≈½×L1, the second sensor 31 is not separated from the nozzles 5 in a downward direction more than necessary, therefore, it is possible to minimize the movement distance to move the hands upward to the position of the nozzles 5 for drying the hands after the airflow generating device 3 is started by inserting the hands from the side openings 2*b*, which is user-friendly.

Moreover, when hands are detected by the first sensor 30 or the second sensor 31, the airflow generating device 3 is started after a lapse of a predetermined time, therefore, even if the hands are inserted from the upper opening 2*a* or the side openings 2*b* at various angles and the hands are detected by the first sensor 30 or the second sensor 31, if a user continues to insert the hands in a normal fashion and does not stop inserting the hands halfway, high speed air is ejected from the nozzles 5 after the portion from the wrists to the fingertips, which is normally the wet portion, is sufficiently inserted into the hand drying chamber 2. Thus, because the wet portion (the area from the wrists to the fingertips) does not protrude above high speed air from the nozzles 5, droplets are not blown outside the hand drying chamber 2 from the wet hands and do not splash to a face or the like of a user. Moreover, even if the insertion speed of the hands is extremely slow and the hands are not completely inserted into the hand drying chamber 2 up to the wrists, a large portion of the hands is in the hand dryer after a lapse of the predetermined time, therefore, the amount of splashing can be reduced.

Moreover, the predetermined time (t2) before the airflow generating device 3 is started after hands are detected by the second sensor 31 is approximately half of the predetermined time (t1) before the airflow generating device 3 is started after hands are detected by the first sensor 30. Therefore, when a person taller than a child, such as an adult, uses the hand dryer by inserting the hands from the upper opening 2*a* or the side openings 2*b* as shown in FIG. 6 and FIG. 8, the ratio of the movement distance (length from fingertips to wrists or the length of the width of hands) in the insertion direction necessary for sufficiently inserting the hands into the hand drying chamber 2 from the upper opening 2*a* or the side openings 2*b* is equivalent to the ratio of t2 to t1. Therefore, even if the hands are inserted from any of the upper opening 2*a* and the side openings 2*b*, the airflow generating device 3 can be started after the hands are sufficiently inserted into the hand drying chamber 2 and the waiting time until the airflow generating device 3 is started after the hands are inserted into the hand drying chamber 2 does not become long, which is user-friendly. Moreover, when a person shorter than an adult, such as a child, uses the hand dryer by inserting the hands from the side openings 2*b* as shown in FIG. 7, although the required insertion distance is the length from the fingertips to the wrists, the hand of a shorter person is approximately as small as the width of the hand of an adult, therefore, even a person shorter than an adult, such as a child, can sufficiently insert the hands up to the wrists before starting the airflow generating device 3 and the waiting time until the airflow generating device 3 is started does not become long, which is user-friendly.

Moreover, when a predetermined time has elapsed after hands are detected by the first sensor 30 or the second sensor 31, if the hands are still detected by the first sensor 30 or the second sensor 31, the airflow generating device 3 is started, therefore, if the hands are removed from the hand drying chamber 2 immediately after the hands are detected by the first sensor 30 or the second sensor 31, the airflow generating device 3 is not started, and the airflow generating device 3 can be started when the hands are surely present in the hand drying chamber 2. Thus, unnecessary operations can be avoided.

Second Embodiment

Figure 9:
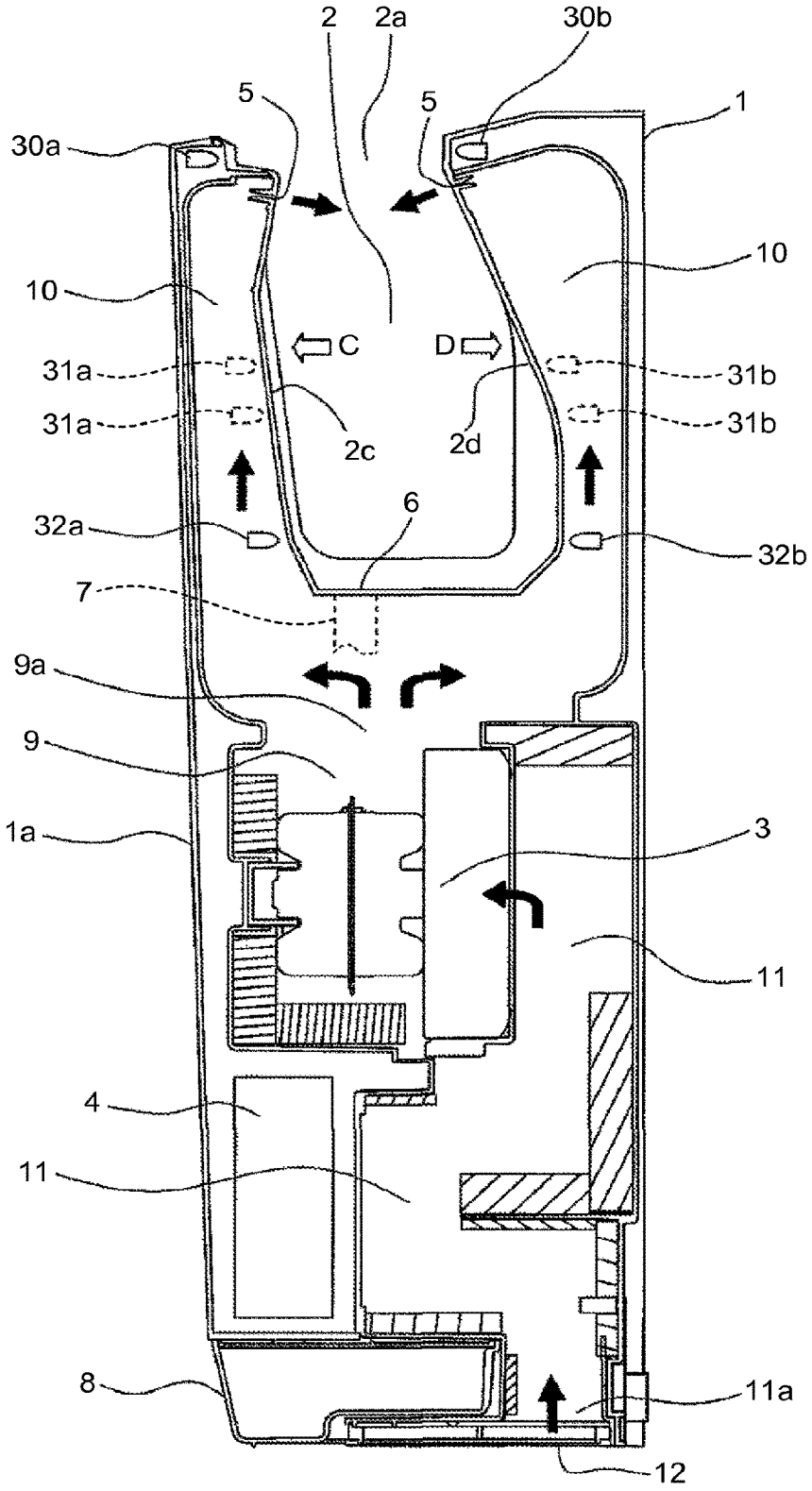
FIG. 9 is a right-side-surface cross-sectional view of a hand dryer according to the second embodiment of this invention.
Figure 10:
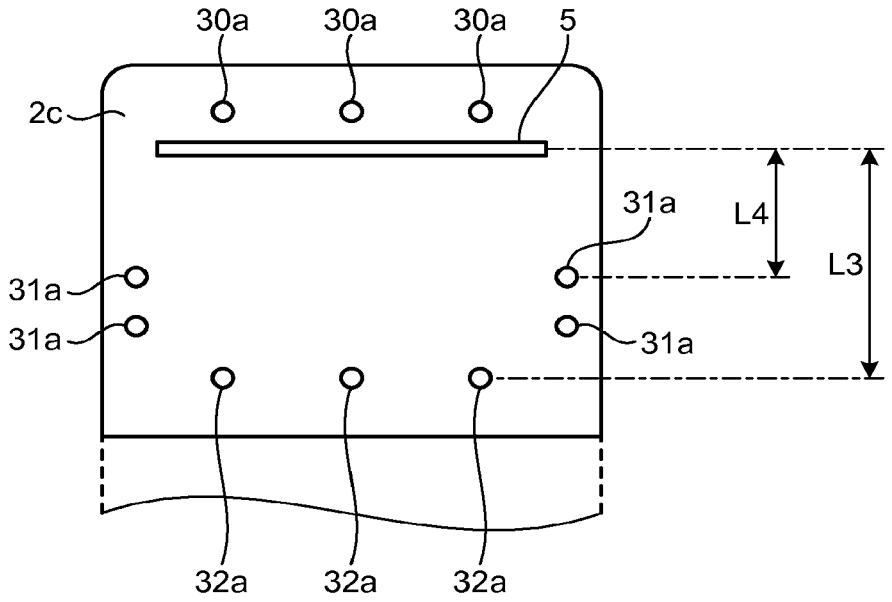
FIG. 10 is an explanatory diagram of the hand dryer according to the second embodiment of this invention illustrating the arrangement of sensors and a nozzle on the inner wall surface of the hand drying chamber viewed in the direction of an arrow C in FIG. 9.
Figure 11:
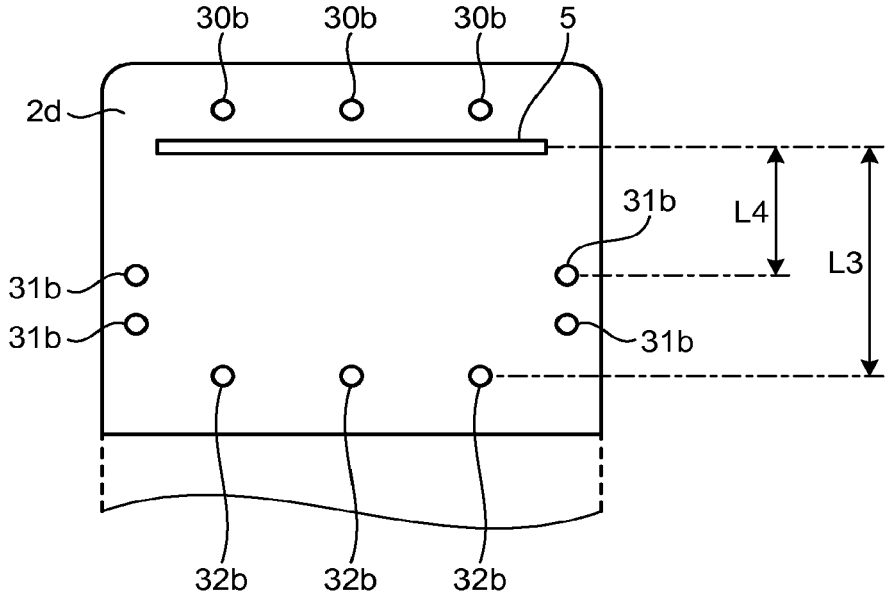
FIG. 11 is an explanatory diagram of the hand dryer according to the second embodiment of this invention illustrating the arrangement of sensors and a nozzle on the inner wall surface of the hand drying chamber viewed in the direction of an arrow D in FIG. 9.

FIG. 9 is a right-side-surface cross-sectional view of a hand dryer according to the second embodiment for carrying out this invention. FIG. 10 is an explanatory diagram of the hand dryer according to the second embodiment of this invention illustrating the arrangement of sensors and a nozzle on the inner wall surface of the hand drying chamber viewed in the direction of an arrow C in FIG. 9. FIG. 11 is an explanatory diagram of the hand dryer according to the second embodiment of this invention illustrating the arrangement of sensors and a nozzle on the inner wall surface of the hand drying chamber viewed in the direction of an arrow D in FIG. 9. As shown in FIG. 9 and FIG. 10, on the front-side wall surface 2*c*, three third sensors (light emitting side) 32*a*, which are light emitting side elements of a third sensor 32, are provided spaced apart in the horizontal direction so that they are located closer to the center than both ends in the horizontal direction of the nozzle 5 and the second sensors (light emitting side) 31*a* in the horizontal direction. Furthermore, in terms of the positional relationship in the vertical direction between the nozzle 5, the second sensors (light emitting side) 31*a*, and the third sensors (light emitting side) 32*a*, they are arranged such that L4 falls within the range from L4≈½×L3 to L4>½×L3, where L4 is the distance in the vertical direction between the nozzle 5 and the second sensors (light emitting side) 31*a* and L3 is the distance in the vertical direction between the nozzle 5 and the third sensors (light emitting side) 32*a*. Although not shown, when one second sensor (light emitting side) 31*a* is provided on each of the right and left sides, it is sufficient to provide them at positions that satisfy L4≈½×L3, at a staggered light emission timing.

As shown in FIG. 11, third sensors (light receiving side) 32*b*, which are light receiving side elements of the third sensor 32, are provided also on the back-side wall surface 2*d* in an arrangement similar to the front-side wall surface 2*c*, and are opposed to the third sensors (light emitting side) 32*a*. Infrared-rays are emitted from the third sensors (light emitting side) 32*a* at a staggered light emission timing from the first sensors (light emitting side) 30*a* and the second sensors (light emitting side) 31*a* and are received by the third sensors (light receiving side) 32*b*. Then, in a similar manner to the first sensor 30 and the second sensor 31, the output signal output from the third sensors (light receiving side) 32*b* is input to the control unit 4 and the control unit 4 determines the presence or absence of an object to be dried by comparing the input signal level with a predetermined threshold. The number of elements of each of the first sensor 30, the second sensor 31, and the third sensor 32 is not limited to the above number.

Figure 12:
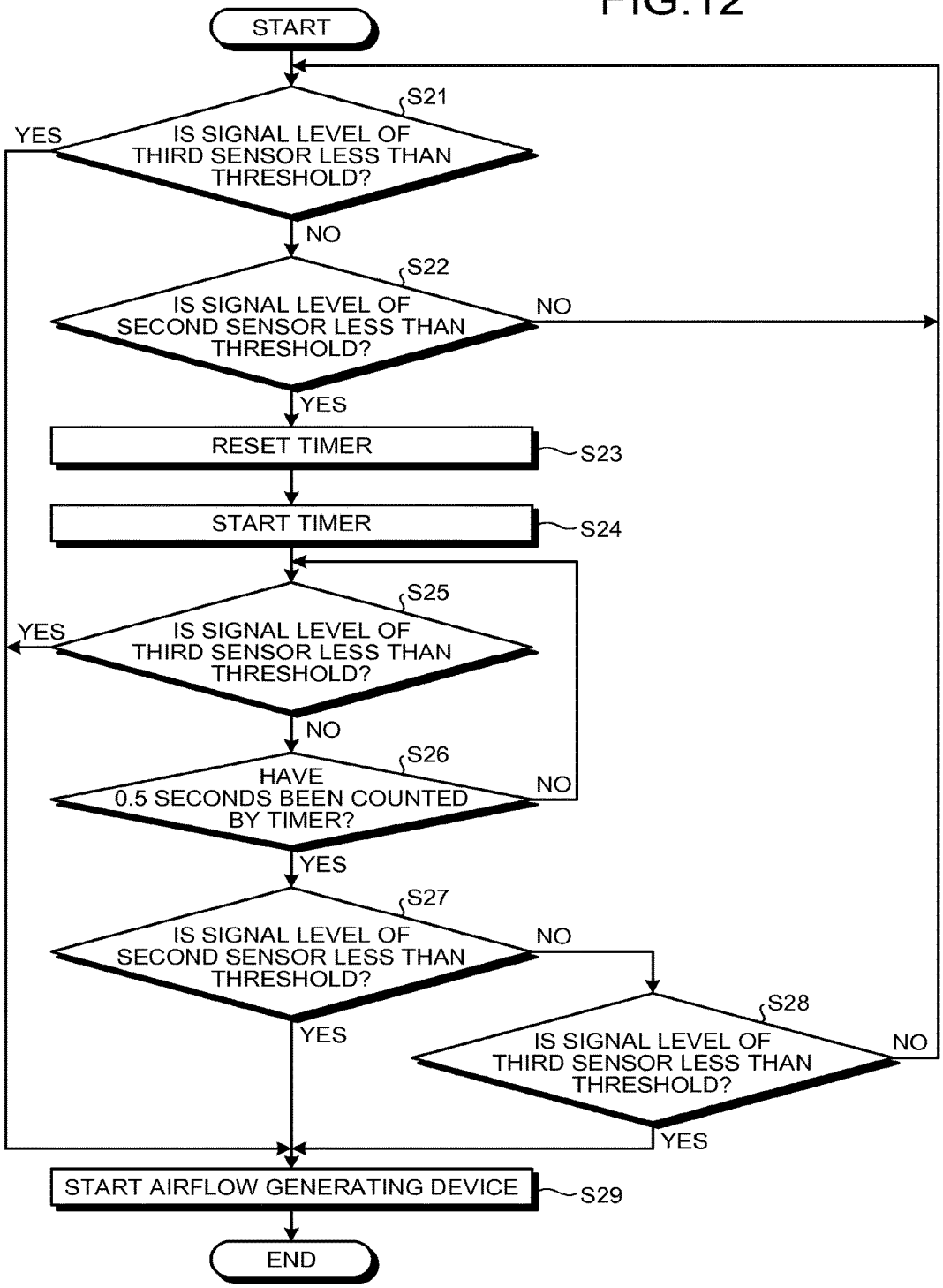
FIG. 12 is a flowchart until the starting of a high-pressure-airflow generating device of the hand dryer according to the second embodiment of this invention.

Next, an explanation is given of the control content of the control unit 4 that controls the operation of the airflow generating device 3 in accordance with a signal from the first sensor 30, or the second sensor 31, or the third sensor 32. FIG. 12 is a flowchart until the starting of the airflow generating device 3 of the hand dryer according to the second embodiment of this invention. In FIG. 12, S21 to S29 represent each step of the flow. When the power (not shown) of the hand dryer is turned on, electricity is supplied to the control unit 4 to enter S21 in a standby state in which the first sensor 30, the second sensor 31, and the third sensor 32 are operated and the hand dryer waits for the hand of a user to be inserted. In S21, it is determined whether the level of an output signal from the third sensor 32 is less than a predetermined threshold. If the level is less than the predetermined threshold, the system control proceeds to S29 and the airflow generating device 3 is started, and otherwise, it proceeds to S22. In S22, it is determined whether the level of an output signal from the second sensor 31 is less than a predetermined threshold. If the level is less than the predetermined threshold, the system control proceeds to S23, and otherwise, it returns to S21.

In S23, a built-in timer (not shown) is reset and the system control thereafter proceeds to S24. In S24, the timer (not shown) reset in S23 is started and the system control thereafter proceeds to S25. In S25, it is determined whether the level of an output signal from the third sensor 32 is less than a predetermined threshold. If the level is less than the predetermined threshold, the system control proceeds to S29, and otherwise, it proceeds to S26. In S26, it is determined whether the timer (not shown) started in S24 has counted elapse of a predetermined time (t3). In the present embodiment, because t3 is set to 0.5 seconds, it is determined whether the timer (not shown) has counted an elapse of 0.5 seconds. If the elapse of 0.5 seconds have been counted, the system control proceeds to S27, and if the elapse of 0.5 seconds have not been counted, the system control returns to S25. In S27, it is determined whether the level of an output signal from the second sensor 31 is less than a predetermined threshold. If the level is less than the predetermined threshold, the system control proceeds to S29, and otherwise, it proceeds to S28. In S28, it is determined whether the level of an output signal from the third sensor 32 is less than a predetermined threshold. If the level is less than the predetermined threshold, the system control proceeds to S29, and otherwise, it returns to S21.

Once the airflow generating device 3 is started, if the level of an output signal from at least one of the first sensor 30, the second sensor 31, and the third sensor 32 is less than a predetermined threshold, the airflow generating device 3 continues to be operated. If the level of an output signal from none of the first sensor 30, the second sensor 31, and the third sensor 32 is less than a predetermined threshold, the airflow generating device 3 is stopped.

Figure 13:
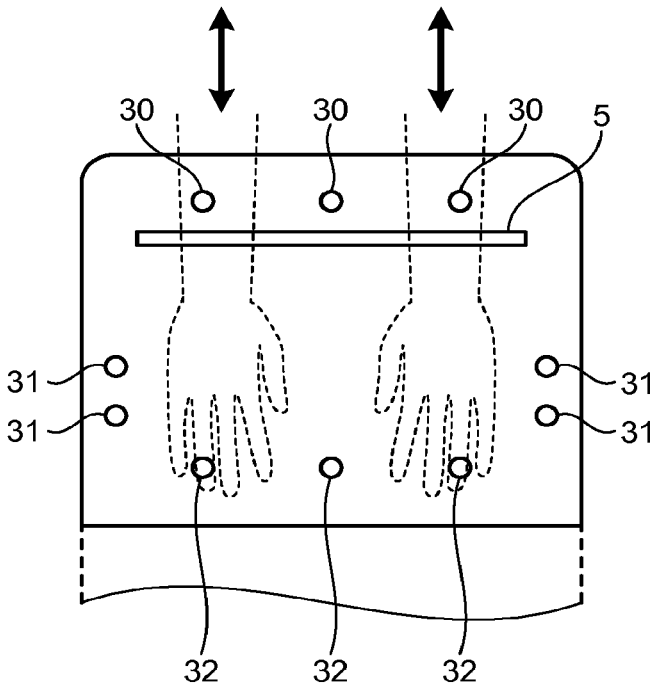
FIG. 13 is an explanatory diagram of the hand dryer according to the second embodiment of this invention showing the hand drying chamber when a person taller than a child, such as an adult, inserts the hands from the upper opening viewed from the front surface perspectively.

Next, an explanation is specifically given of a case where wet hands are inserted. FIG. 13 is an explanatory diagram of the hand dryer according to the second embodiment of this invention showing the hand drying chamber 2 when a person taller than a child, such as an adult, inserts the hands from the upper opening 2*a* viewed from the front surface perspectively. When a user starts inserting both hands downward into the hand drying chamber 2 from the upper opening 2*a* in a state where the palms are open, the first sensor 30 is blocked by a portion near the fingertips and the hands are detected. However, this is not related to the determination in S21 and S22 and the hands are not detected by the second sensor 31, therefore, the system control does not proceed to a step other than S21 and S22 and the airflow generating device 3 remains stopped. When the hands continue to be inserted and the third sensor 32 is blocked by a portion near the fingertips of the hands and detects the hands, the system control proceeds to S29 from S21. Then, the airflow generating device 3 is started and high speed air is ejected from the nozzles 5, and a user dries all over the hands by pulling out the hands from the upper opening 2*a*. When both hands are completely removed from the upper opening 2*a*, the airflow generating device 3 is stopped.

Figure 14:
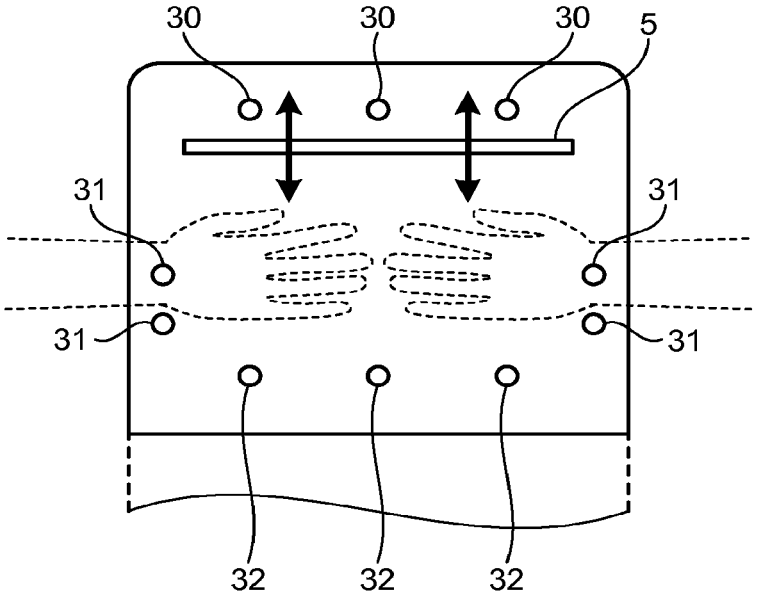
FIG. 14 is an explanatory diagram of the hand dryer according to the second embodiment of this invention showing the hand drying chamber when a person shorter than an adult, such as a child, inserts the hands from the side openings viewed from the front surface perspectively.

FIG. 14 is an explanatory diagram of the hand dryer according to the second embodiment of this invention showing the hand drying chamber 2 when a person shorter than an adult, such as a child, inserts the hands from the side openings 2*b* viewed from the front surface perspectively. When a user laterally (horizontal direction) inserts both hands into the hand drying chamber 2 from the side openings 2*b* in a state where the palms are open, the second sensor 31 is blocked by a portion near the fingertips of the hands and the hands are detected, and the system control proceeds to S23 and S24 from S22 and the timer is started. Both of the inserted hands continue to be laterally inserted. If the third sensor 32 is blocked by a portion near the side surfaces of the hands or the like and the hands are detected, the system control proceeds to S29 from S25, and the airflow generating device 3 is started and high speed air is ejected from the nozzles 5.

Even when the hands are not detected by the third sensor 32 in S25, if the inserted hands continue to be inserted in a normal fashion without being stopped halfway, the wet portion from the fingertips to the wrists sufficiently enters the hand drying chamber 2 while the timer counts an elapse of 0.5 seconds in S26. Therefore, when 0.5 seconds have elapsed in S26, the second sensor 31 is blocked by a portion near the arms and the hands are detected. Thus, the system control proceeds to S29 from S27, and the airflow generating device 3 is started and high speed air is ejected from the nozzles 5. Moreover, even when both arms are moved upward to form an inverted V-shape and therefore a portion near the arms is not detected by the second sensor 31, if the hands are detected by the third sensor 32, the system control proceeds to S29 from S28, and the airflow generating device 3 is started and high speed air is ejected from the nozzles 5. If the hands are detected by the second sensor 31 or the third sensor 32 in S27 or S28, the system control proceeds to S29, and the airflow generating device 3 is started and high speed air is ejected from the nozzles 5. Thus, a user dries all over the hands by pulling out the hands from the upper opening 2*a*.

Other configurations and operations are the same as or similar to those in the first embodiment, therefore, the same reference numerals are used in the drawings and explanation thereof is omitted.

According to the hand dryer having the above configuration, because the third sensor 32 is provided below the nozzles 5 and closer to the center than the second sensor 31 in the horizontal direction, even if hands are inserted from the upper opening 2*a* or the side openings 2*b*, the third sensor 32 can detect the hands on the deeper side in the hand drying chamber 2 than the first sensor 30 and the second sensor 31, therefore, the airflow generating device 3 can be started after the hands are inserted into the hand drying chamber 2 more surely.

Moreover, because the third sensor 32 is provided below the second sensor 31, hands inserted from the upper opening 2*a* can be detected by the third sensor 32 in a state where the hands are inserted as far as the deep side in a lower portion of the hand drying chamber 2. Moreover, the position of the hands inserted just casually from the side openings 2*b* is near the center in the vertical direction of the side openings 2*b* located above the third sensor 32, therefore, the hands inserted from the side openings 2*b* can be easily detected by the second sensor 31, which is user-friendly.

Moreover, the distance L3 in the vertical direction between the nozzle 5 and the third sensor 32 indispensably needs to have a length capable of accommodating a portion from the wrist to the fingertips of a normal adult. However, if the distance L3 is made longer than necessary, the size of the hand dryer increases, which reduces the ease of installation, therefore, the distance L3 is set substantially in accordance with the size from the wrist to the fingertips of a normal adult hand. Moreover, as described in the first embodiment, the size of the palm of human hand is such that the width of a hand is approximately equal to half the length from the wrist to the fingertips.

Therefore, because the second sensor 31 is provided below the intermediate position between the nozzle 5 and the third sensor 32, the distance L4 between the nozzle 5 and the second sensor 31 is equal to or more than the width of a hand. Thus, in a similar manner to the first embodiment, even if high speed air is ejected from the nozzles 5 while inserting hands, for example, in the case where the hands of an adult or a child are slowly inserted from the side openings 2*b* by a usage shown in FIG. 7, the high speed air from the nozzles 5 is not directly applied to the hands and the wet hands do not protrude above the high speed air from the nozzles 5. Thus, water on the hands is not splashed outside the hand dryer. Moreover, because the second sensor 31 is not separated from the nozzles 5 in a downward direction more than necessary, it is possible to minimize the movement distance to move the hands upward to the position of the nozzles 5 for drying the hands, which is user-friendly.

Moreover, when hands are detected by the second sensor 31 or the third sensor 32, the airflow generating device 3 is started. Therefore, when the hands are inserted from the upper opening 2*a*, even if the hands, such as the fingertips, are detected by the first sensor 30 while inserting the hands, the airflow generating device 3 is not started, and, when the hands are detected by the third sensor 32 provided on the deep side in the hand drying chamber 2 below the nozzle 5, the airflow generating device 3 is started. Therefore, the airflow generating device 3 is started in a state where the fingertips or the like are surely inserted as far as the position of the third sensor 32. Thus, because the wet portion (the area from the wrists to the fingertips) of the hands does not certainly protrude above high speed air ejected from the nozzles 5 regardless of the insertion speed or the like such as in the case where the hands are slowly inserted or a user once stops inserting the hands halfway and then inserts the hands, it is possible to surely prevent water from being blown outside the hand drying chamber 2 from the wet hands and being splashed to the face or the like of a user. Moreover, when the hands of a shorter person, such as a child, are inserted from the side openings 2*b*, even if the hands are not detected by the third sensor 32 located near the bottom portion on the deep side in the hand drying chamber 2, the hands are easily detected by the second sensor 31 near the side openings 2*b*, which is user-friendly.

Moreover, when hands are detected by the second sensor 31 or when a predetermined time has elapsed after hands are detected by the third sensor 32, the airflow generating device 3 is started. Therefore, in a usage of inserting hands from the side openings 2*b*, even if a user is used to using the hand dryer and the predetermined time t3=0.5 seconds seems long to the user, when the hands are detected by the third sensor 32, the airflow generating device 3 is started even if the timer has not counted an elapse of 0.5 seconds, which is user-friendly.

Moreover, after a lapse of a predetermined time, when hands are detected by the second sensor 31 or the third sensor 32, the airflow generating device 3 is started, therefore, the airflow generating device 3 can be started when the hands are surely in the hand drying chamber 2. Thus, unnecessary operations, such as causing the airflow generating device 3 to start even if the hands are already removed, can be avoided.

Third Embodiment

Figure 15:
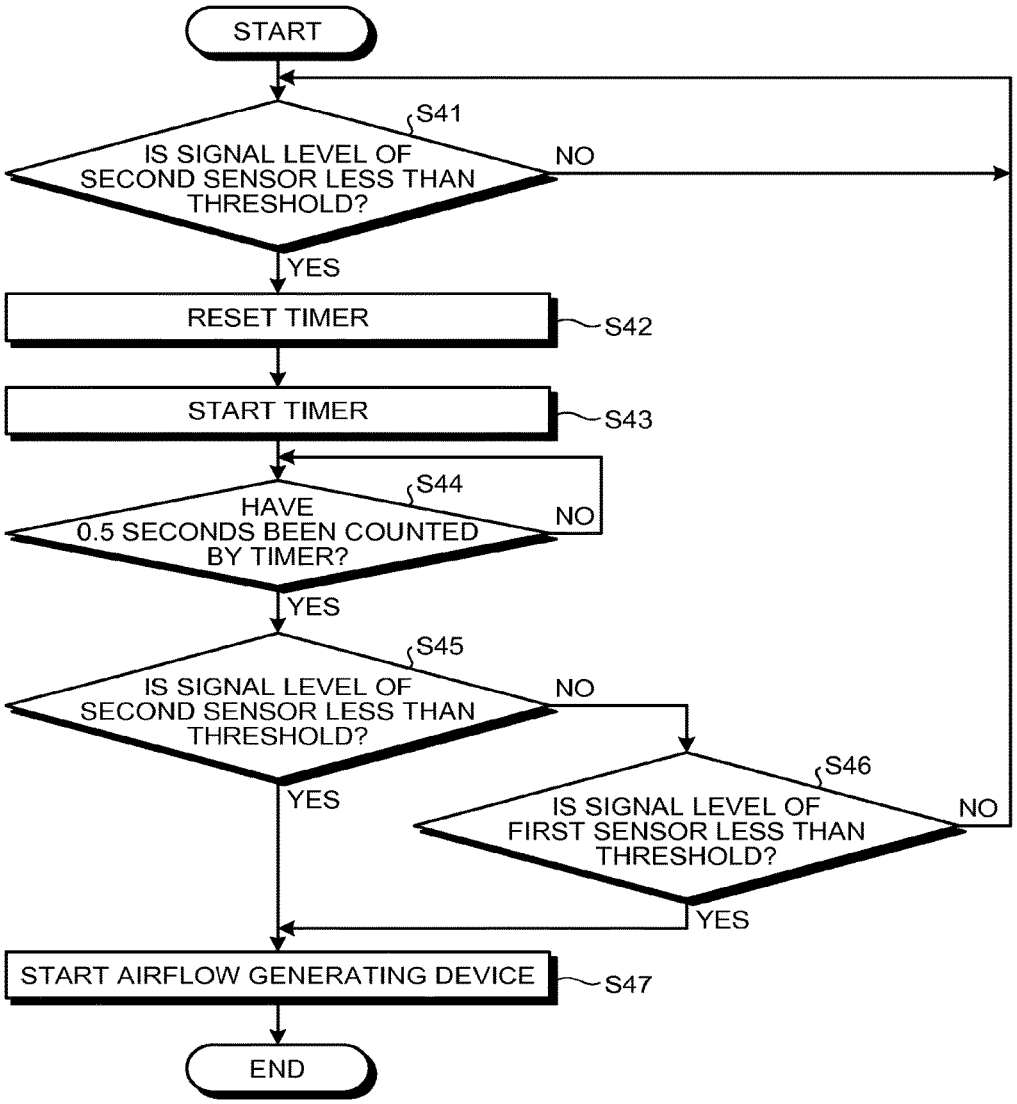
FIG. 15 is a flowchart until the starting of a high-pressure-airflow generating device of a hand dryer according to the third embodiment of this invention.

In the hand dryer according to the third embodiment of this invention, the control content of the control unit 4, which controls the operation of the airflow generating device 3 in accordance with a signal from the first sensor 30 or the second sensor 31, is different from the first embodiment, and other configurations and operations are the same as or similar to those in the first embodiment and therefore explanation thereof is omitted. FIG. 15 is a flowchart until the starting of the airflow generating device 3 of the hand dryer according to the third embodiment of this invention. In FIG. 15, S41 to S47 represent each step of the flow. When the power (not shown) of the hand dryer is turned on, electricity is supplied to the control unit 4 to enter S41 in a standby state in which the first sensor 30 and the second sensor 31 are operated and the hand dryer waits for the hand of a user to be inserted. In S41, it is determined whether the level of an output signal from the second sensor 31 is less than a predetermined threshold. If the level is less than the predetermined threshold, the system control proceeds to S42, and otherwise, it returns to S41. In S42, a built-in timer (not shown) is reset and the system control thereafter proceeds to S43. In S43, the timer (not shown) reset in S42 is started and the system control thereafter proceeds to S44.

In S44, it is determined whether the timer (not shown) started in S42 has counted elapse of a predetermined time (t4). In the present embodiment, because t4 is set to 0.5 seconds, it is determined whether the timer (not shown) has counted an elapse of 0.5 seconds. If the elapse of 0.5 seconds have been counted, the system control proceeds to S45, and if the elapse of 0.5 seconds have not been counted, the system control returns to S44. In S45, it is determined whether the level of an output signal from the second sensor 31 is less than a predetermined threshold. If the level is less than the predetermined threshold, the system control proceeds to S47, and otherwise, it proceeds to S46. In S46, it is determined whether the level of an output signal from the first sensor 30 is less than a predetermined threshold. If the level is less than the predetermined threshold, the system control proceeds to S47, and otherwise, it returns to S41. In S47, the airflow generating device 3 is started. Once the airflow generating device 3 is started, if the level of an output signal from at least any one of the first sensor 30 and the second sensor 31 is less than a predetermined threshold, the airflow generating device 3 continues to be operated. If the level of an output signal from none of the first sensor 30 and the second sensor 31 is less than a predetermined threshold, the airflow generating device 3 is stopped.

A person taller than a child, such as an adult, uses the hand dryer by inserting the hands from the side openings 2*b* as shown in FIG. 8 without inserting the hands from the upper opening 2*a*. As shown in FIG. 8, when a user starts inserting the hands into the hand drying chamber 2 from the side openings 2*b* on the right and left sides by moving the hands in the horizontal direction in a state where both arms extend downward and the palms are open, the second sensor 31 is blocked by a portion near the side ends of the palms and backs of the hands. Therefore, the level of an output signal from the second sensor 31 decreases and the system control proceeds to S42 from S41 and proceeds up to S43. Because 0.5 seconds are caused to elapse in S44, the wet portion from the fingertips to the wrists of both hands, which continue to be inserted during this period, sufficiently enters the hand drying chamber 2 and the arms emerge from the upper opening 2*a*, and the hands are inserted into the hand drying chamber 2 as far as the position more inward than the second sensor 31. Therefore, the second sensor 31 is not blocked by the hands and the first sensor 30 is blocked by a portion near the arms, thus, the output signal from the first sensor 30 decreases and the system control proceeds to S46 from S45, and the airflow generating device 3 is started and high speed air is ejected from the nozzles 5. Moreover, even if the hands are not moved to the position at which the first sensor 30 is blocked after the timer counts the elapse of 0.5 seconds in S44, for example, because the insertion speed of the hands is slow, if the hands are detected by the second sensor 31, the system control proceeds to S47 from the S45 and the airflow generating device 3 is started. When the airflow generating device 3 is started, a user dries all over the hands by pulling out the hands from the upper opening 2*a*. In a similar manner to the first embodiment, a person shorter than an adult, such as a child, uses the hand dryer by inserting the hands from the side openings 2*b* as shown in FIG. 7.

According to the hand dryer having the above configuration, in a state where hands are not detected by the first sensor 30 and the second sensor 31, when the hands are detected by the second sensor 31, the airflow generating device 3 is started, therefore, the airflow generating device 3 is not started unless the hands are detected by the second sensor 31 earlier than the first sensor 30. This means that a user can be limited to always inserting the hands from the side openings 2*b* for using the hand dryer. When the hands are inserted from the upper opening 2*a*, in some cases, the airflow generating device 3 is started in a state where the hands are not sufficiently inserted into the hand drying chamber 2 as far as a portion near the wrists and high speed air is ejected from the nozzles 5 depending on a user such as in the case where the insertion speed is slow and the hand to be inserted is extremely larger than a normal adult hand.

If the high speed air is ejected from the nozzles 5 while inserting the hands, the hands are pushed in a direction vertical to the surface of an air curtain formed by the high speed air ejected from the nozzles 5 by the insertion. Therefore, water adhering to the hands protruded outside the air curtain splashes outside the hand dryer due to the force of the air curtain by the pushing operation of the hands. Specially, water is easy to splash in a direction that is opposite to the insertion direction and is vertical to the surface of the air curtain, therefore, when the hands are inserted from the upper opening 2*a*, water splashes to the arm, the sleeve, or the face of the user that is present in the opening direction of the upper opening 2*a*. However, if the hand dryer is controlled such that the airflow generating device 3 is not started unless the hands are always inserted from the side openings 2*b*, the hands are always inserted in a direction parallel to the surface of the air curtain even if there is a variation between users. Thus, even if high speed air is ejected from the nozzles 5 while inserting the hands, droplets are hardly splashed to the user, thereby enabling to improve the usability.

Moreover, after hands are detected by the second sensor 31 and then, after a lapse of a predetermined time, when the hands are detected by the first sensor 30 or the second sensor 31, the airflow generating device 3 is started. Therefore, the airflow generating device 3 can be started when the hands are surely in the hand drying chamber 2. Thus, unnecessary operations, such as causing the airflow generating device 3 to start even when the hands are removed, can be avoided.

Fourth Embodiment

Figure 16:
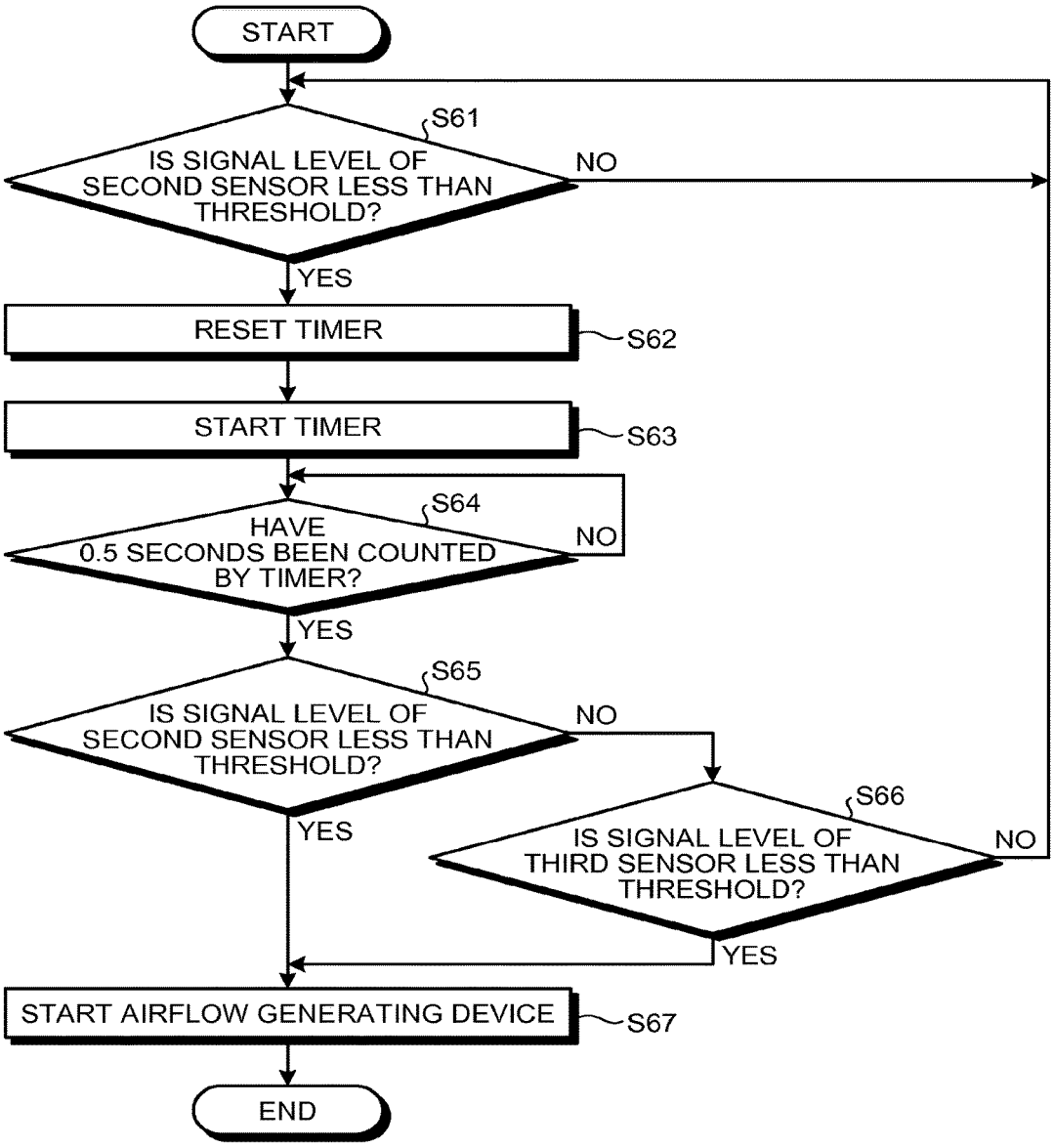
FIG. 16 is a flowchart until the starting of a high-pressure-airflow generating device of a hand dryer according to the fourth embodiment of this invention.

In the hand dryer according to the fourth embodiment of this invention, the control content of the control unit 4, which controls the operation of the airflow generating device 3 in accordance with a signal from the first sensor 30, the second sensor 31, or the third sensor 32, is different from the second embodiment, and other configurations and operations are the same as or similar to those in the second embodiment and therefore explanation thereof is omitted. FIG. 16 is a flowchart until the starting of the airflow generating device 3 of the hand dryer according to the fourth embodiment of this invention. In FIG. 16, S61 to S67 represent each step of the flow. When the power (not shown) of the hand dryer is turned on, electricity is supplied to the control unit 4 to enter S61 in a standby state in which the first sensor 30, the second sensor 31, and the third sensor 32 are operated and the hand dryer waits for the hand of a user to be inserted. In S61, it is determined whether the level of an output signal from the second sensor 31 is less than a predetermined threshold. If the level is less than the predetermined threshold, the system control proceeds to S62, and otherwise, it returns to S61. In S62, a built-in timer (not shown) is reset and the system control thereafter proceeds to S63. In S63, the timer (not shown) reset in S62 is started and the system control thereafter proceeds to S64.

In S64, it is determined whether the timer (not shown) started in S62 has counted elapse of a predetermined time (t5). In the present embodiment, because t5 is set to 0.5 seconds, it is determined whether the timer (not shown) has counted an elapse of 0.5 seconds. If the elapse of 0.5 seconds have been counted, the system control proceeds to S65, and if the elapse of 0.5 seconds have not been counted, the system control returns to S64. In S65, it is determined whether the level of an output signal from the second sensor 31 is less than a predetermined threshold. If the level is less than the predetermined threshold, the system control proceeds to S67, and otherwise, it proceeds to S66. In S66, it is determined whether the level of an output signal from the third sensor 32 is less than a predetermined threshold. If the level is less than the predetermined threshold, the system control proceeds to S67, and otherwise, it returns to S61. In S67, the airflow generating device 3 is started. Once the airflow generating device 3 is started, if the level of an output signal from at least any one of the first sensor 30, the second sensor 31, and the third sensor 32 is less than a predetermined threshold, the airflow generating device 3 continues to be operated. If the level of an output signal from none of the first sensor 30, the second sensor 31, and the third sensor 32 is less than a predetermined threshold, the airflow generating device 3 is stopped.

According to the hand dryer having the above configuration, in a state where hands are not detected by the first sensor 30, the second sensor 31, and the third sensor 32, when the hands are detected by the second sensor 31, the airflow generating device 3 is started. Thus, the effects similar to those in the second embodiment are obtained.

Moreover, after hands are detected by the second sensor 31 and then, after a lapse of a predetermined time, when the hands are detected by the second sensor 31 or the third sensor 32, or, after hands are detected by the second sensor 31 and then, after a lapse of a predetermined time, when the hands are detected by the first sensor 30 and thereafter the hands are detected by the third sensor 32 in a state where the hands are detected by the first sensor 30, the airflow generating device 3 is started. Thus, the airflow generating device 3 can be started when the hands are surely inserted as far as the deep side of the hand drying chamber 2 lower than the nozzles 5, therefore, the wet portion of the hands does not protrude above high speed air from the nozzles 5. Thus, droplets splashed to a user can be reduced more surely.

Fifth Embodiment

Figure 17:
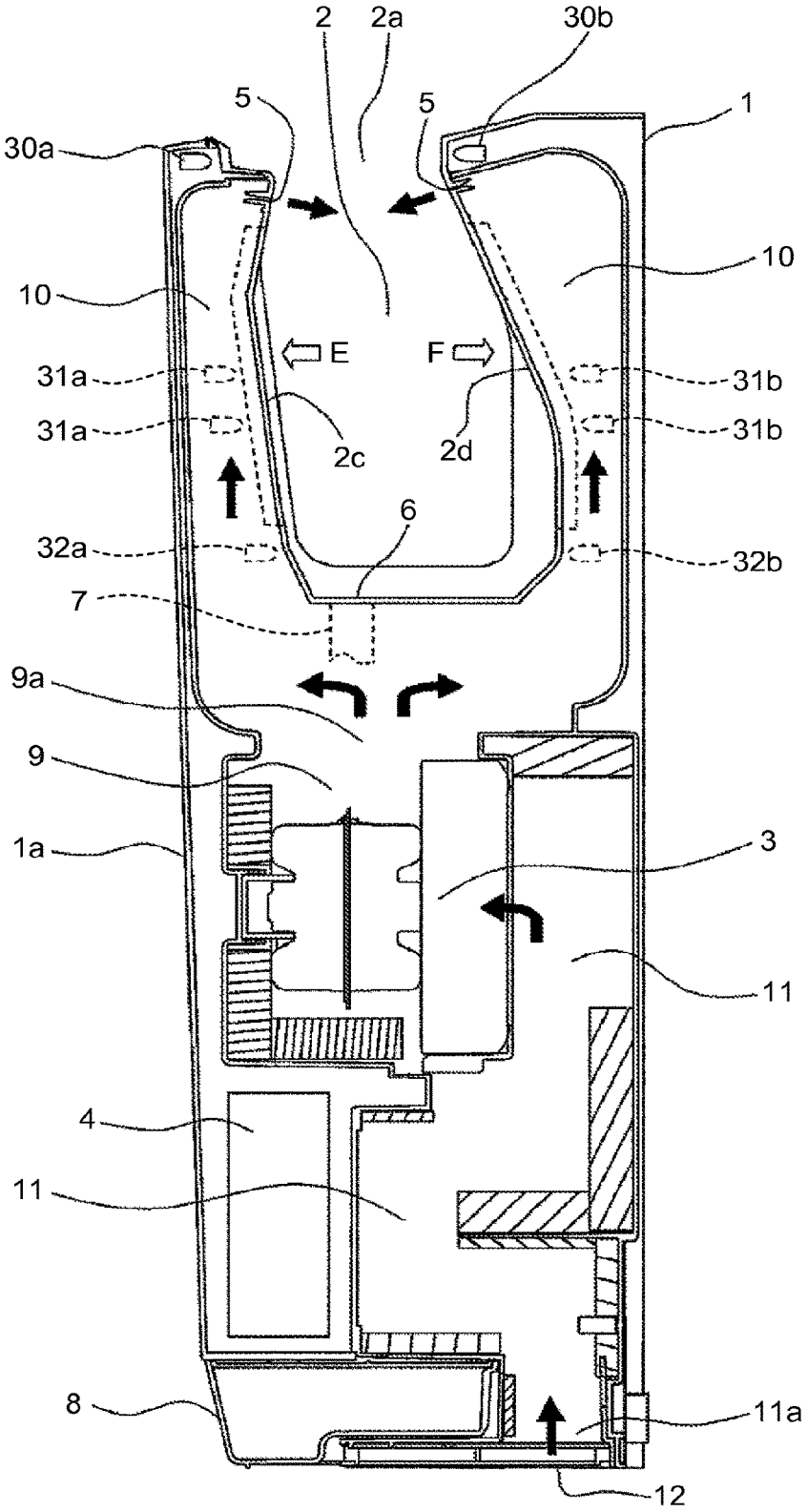
FIG. 17 is a right-side-surface cross-sectional view of a hand dryer according to the fifth embodiment of this invention.
Figure 18:
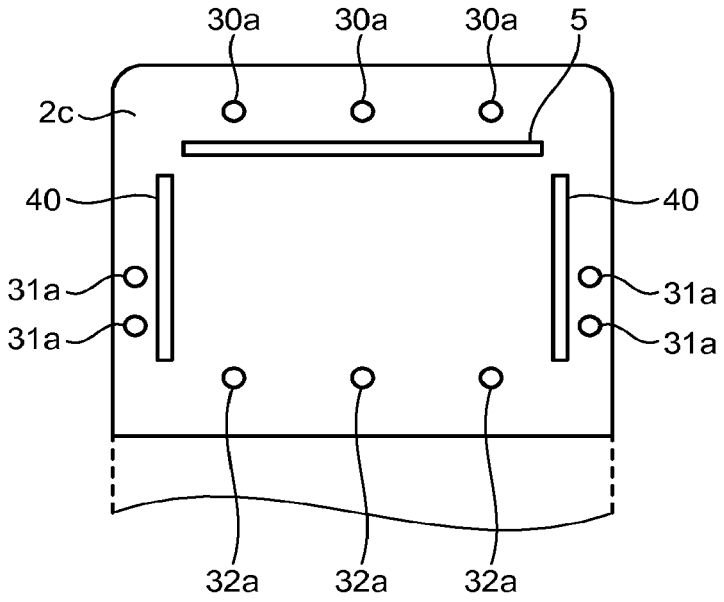
FIG. 18 is an explanatory diagram of the hand dryer according to the fifth embodiment of this invention illustrating the arrangement of sensors and nozzles on the inner wall surface of the hand drying chamber viewed in the direction of an arrow E in FIG. 17.
Figure 19:
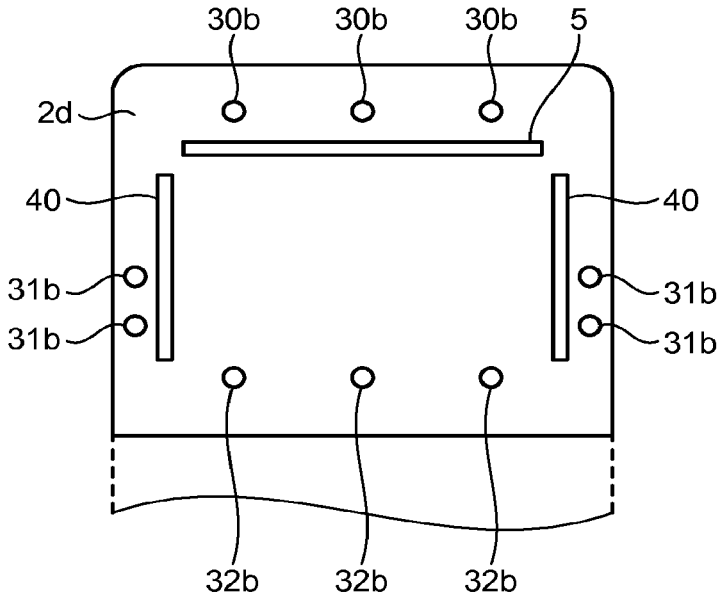
FIG. 19 is an explanatory diagram of the hand dryer according to the fifth embodiment of this invention illustrating the arrangement of sensors and nozzles on the inner wall surface of the hand drying chamber viewed in the direction of an arrow F in FIG. 17.

FIG. 17 is a side-surface cross-sectional view of a hand dryer according to the fifth embodiment for carrying out this invention. FIG. 18 is an explanatory diagram of the hand dryer according to the fifth embodiment of this invention illustrating the arrangement of sensors and nozzles on the inner wall surface of the hand drying chamber viewed in the direction of an arrow E in FIG. 17. Moreover, FIG. 19 is an explanatory diagram of the hand dryer according to the fifth embodiment of this invention illustrating the arrangement of sensors and nozzles on the inner wall surface of the hand drying chamber viewed in the direction of an arrow F in FIG. 17. As shown in FIG. 17 and FIG. 18, on the front-side wall surface 2*c*, a second nozzle 40 is provided substantially linearly in the vertical direction between the nozzle 5 and the third sensors (light emitting side) 32*a* in the vertical direction at each position, which is closer to the center than the second sensors (light emitting side) 31*a* in the horizontal direction and near the second sensors (light emitting side) 31*a*, to exhibit bilateral symmetry. The second nozzles 40 communicate with the exhaust ducts 10. Moreover, as shown in FIG. 19, the second nozzles 40 are provided on the back-side wall surface 2*d* in a similar arrangement and communicate with the exhaust ducts 10. When the airflow generating device 3 is started, high speed air is ejected from the nozzles 5 and also from the second nozzles 40 toward the hand drying chamber 2.

Other configurations and operations are the same as or similar to those in the second embodiment, therefore, the same reference numerals are used in the drawings and explanation thereof is omitted.

According to the hand dryer having the above configuration, because the second nozzles 40, which eject airflow generated in the airflow generating device 3 into the hand drying chamber 2, are provided on the inner wall surface of the hand drying chamber 2 at positions that are below the nozzles 5 and are closer to the center than the second sensor 31 in the horizontal direction. Therefore, when a person shorter than an adult, such as a child, uses the hand dryer by inserting the hands from the side openings 2*b*, it is possible to dry the hands by the second nozzles 40 simply by directly pulling out the hands from the side openings 2*b* without moving the hands upward as far as the position of the nozzles 5 for drying the hands after the airflow generating device 3 is started, which is more user-friendly.

Moreover, when a person taller than a child, such as an adult, uses the hand dryer by inserting the hands from the upper opening 2*a*, even if water splashes toward the side openings 2*b* from the inside of the hand drying chamber 2 by the air curtain formed by high speed air ejected from the second nozzles 40, the water is blocked by the air curtain formed by high speed air from the second nozzles 40, therefore, water can be prevented from splashing out of the hand dryer from the side openings 2*b*.

Figure 20:
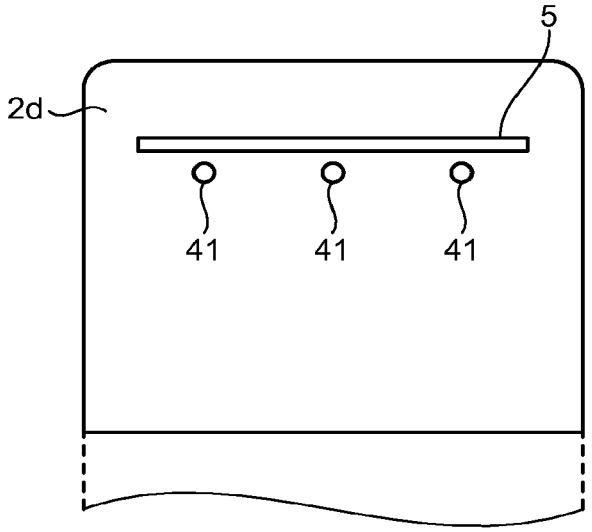
FIG. 20 is an explanatory diagram illustrating another example of the hand dryer according to any of the first embodiment to fifth embodiment of this invention.

FIG. 20 is an explanatory diagram illustrating another example of the hand dryer according to any of the first embodiment to fifth embodiment of this invention. In the first embodiment to fifth embodiment, a light emitting element and a light receiving element form a pair in each of the first sensor 30, the second sensor 31, and the third sensor 32 as an example, however, as shown in FIG. 20, if emission of the infrared-rays from the first sensor 30, the second sensor 31, and the third sensor 32 is performed at staggered light emission timing from one another and common sensors (light receiving side) 41 that receive all the infrared-rays from the first sensor 30, the second sensor 31, and the third sensor 32 are provided, the sensor arrangement can be simplified. Moreover, although not shown, if a light emitting element and a light receiving element are arranged only on any one of the front-side wall surface 2*c* and the back-side wall surface 2*d* and the hands are detected by reflection from the hands, sensors can be arranged only on one side, therefore, the configuration of the hand dryer can be further simplified.

REFERENCE SIGNS LIST

1 box body
2 hand drying chamber
**2*a*** upper opening
**2*b*** side opening
**2*c*** front-side wall surface
**2*d*** back-side wall surface
3 airflow generating device
4 control unit
5 nozzle
6 drainage port
7 drain channel
8 tank
9 exhaust chamber
**9*a*** exhaust port
10 exhaust duct
11 intake duct
**11*a*** intake port
12 filter
30 first sensor

30*a* first sensor (light emitting side)
30*b* first sensor (light receiving side)
31 second sensor
31*a* second sensor (light emitting side)
31*b* second sensor (light receiving side)
32 third sensor
32*a* third sensor (light emitting side)
32*b* third sensor (light receiving side)
40 second nozzle
41 sensor (light receiving side)

The invention claimed is:

1. A hand dryer, comprising:

a box body that includes a hand drying chamber configured to receive a hand via one of openings of an upper portion and a side portion of the hand drying chamber;

an airflow generator provided in the box body and configured to generate an airflow;

a nozzle provided on an inner wall surface of the hand drying chamber and configured to eject an airflow generated by the airflow generator to the hand drying chamber;

a control unit; and a plurality of sensors provided on an inner wall surface of the hand drying chamber and configured to detect a presence or an absence of a hand and to output a signal indicative of a presence or an absence of a hand, the plurality of sensors including:

a lower light emitter;

a lower light receiver configured to receive light emitted from the lower light emitter;

a side light emitter provided above the lower light emitter and more outward than a most outward lower light emitter in a horizontal direction; and a side light receiver configured to receive light emitted from the side light emitter; wherein the control unit is configured to control an operation of the airflow generator based on a signal of one of the lower light receiver and the side light receiver.

2. The hand dryer according to claim 1, wherein the hand dryer includes a plurality of side light emitters; and each one of the plurality of side light emitters is provided more outward than the lower light emitter.

3. The hand dryer according to claim 2, wherein the hand dryer includes only a single lower light emitter; and each one of the plurality of side light emitters is provided more outward than the single lower light emitter.

4. The hand dryer according to claim 1, wherein the hand dryer includes:

a plurality of lower light emitters;

a plurality of side light emitters; and each one of the plurality of side light emitters is provided more outward than each one of the plurality of lower light receivers.

5. The hand dryer according to claim 1, wherein the side light emitter is provided below the nozzle.

6. The hand dryer according to claim 5, wherein the side light emitter is provided below a vertical position midway between the nozzle and the lower light emitter.

7. The hand dryer according to claim 1, wherein the control unit is configured to start the airflow generator when a hand is detected by one of the side light receiver and the lower light receiver.

8. The hand dryer according to claim 1, wherein the control unit is configured to start the airflow generator when a hand is detected by one of the side light receiver or the lower light receiver from a state a hand is not detected by the side light receiver and the lower light receiver.

9. The hand dryer according to claim 1, wherein the control unit is configured to stop the airflow generator when a hand is not detected by the side light receiver and the lower light receiver.

10. The hand dryer according to claim 1 wherein the side light receiver is provided above the lower light receiver.

11. The hand dryer according to claim 1, wherein the side light receiver is provided more outward than a most outward lower light receiver in the horizontal direction.

* * * * *